US011201396B2

(12) United States Patent
Park et al.

(10) Patent No.: US 11,201,396 B2
(45) Date of Patent: Dec. 14, 2021

(54) ANTENNA MODULE AND ELECTRONIC DEVICE COMPRISING THE SAME

(71) Applicant: Samsung Electronics Co., Ltd., Gyeonggi-do (KR)

(72) Inventors: Jungmin Park, Gyeonggi-do (KR); Chih Wei Lee, Gyeonggi-do (KR); Chonghwa Seo, Gyeonggi-do (KR); Sungcheol Yoo, Gyeonggi-do (KR); Jongwon Lee, Gyeonggi-do (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 55 days.

(21) Appl. No.: 16/702,948

(22) Filed: Dec. 4, 2019

(65) Prior Publication Data

US 2020/0185826 A1 Jun. 11, 2020

(30) Foreign Application Priority Data

Dec. 7, 2018 (KR) ..... 10-2018-0157331

(51) Int. Cl.

| | |
|---|---|
| ***H01Q 1/52*** | (2006.01) |
| ***H01Q 21/06*** | (2006.01) |
| ***H01Q 21/00*** | (2006.01) |
| ***H01Q 1/24*** | (2006.01) |

(52) U.S. Cl.

CPC ..... *H01Q 1/526* (2013.01); *H01Q 1/246* (2013.01); *H01Q 21/0025* (2013.01); *H01Q 21/065* (2013.01)

(58) Field of Classification Search

CPC ..... H01Q 1/52; H01Q 1/526; H01Q 21/06; H01Q 21/065

See application file for complete search history.

(56) References Cited

U.S. PATENT DOCUMENTS

| | | | | |
|---|---|---|---|---|
| 9,881,882 | B2 | 1/2018 | Hsu et al. | |
| 9,923,261 | B2 | 3/2018 | Jin et al. | |
| 10,084,241 | B1 | 9/2018 | Jenwatanavet et al. | |
| 10,170,838 | B2 | 1/2019 | Garcia et al. | |
| 10,340,235 | B2 | 7/2019 | Hsu et al. | |
| 10,418,687 | B2 | 9/2019 | Mow et al. | |
| 10,431,892 | B2 | 10/2019 | Garcia et al. | |
| 10,580,745 | B1 * | 3/2020 | Wieland | H01L 23/498 |
| 2006/0170597 | A1 * | 8/2006 | Kurashima | H01Q 1/242 343/700 MS |
| 2007/0229363 | A1 | 10/2007 | Kurashima et al. | |
| 2009/0082075 | A1 * | 3/2009 | Honda | H04M 1/0214 455/575.7 |

(Continued)

OTHER PUBLICATIONS

International Search Report dated Apr. 2, 2020.

*Primary Examiner* — Jason Crawford

(74) *Attorney, Agent, or Firm* — Cha & Reiter, LLC

(57) ABSTRACT

An antenna module comprises a printed circuit board, a communication circuit disposed on a first surface of the printed circuit board, an array antenna configured to transmit/receive a signal in a specified high-frequency band with the communication circuit, wherein the array antenna includes, first conductive elements disposed on the first surface of the printed circuit board, and second conductive elements disposed on a second surface facing the first conductive elements, and a first molding layer covering the first conductive elements.

4 Claims, 21 Drawing Sheets

230: 230a, 230b

231: 231a, 231b
232: 232a, 232b
233: 233a, 233b
234: 234a, 234b

(56) References Cited

U.S. PATENT DOCUMENTS

| | | | | |
|---|---|---|---|---|
| 2014/0028518 | A1* | 1/2014 | Arnold | H01L 23/66 343/841 |
| 2014/0226291 | A1* | 8/2014 | Gibbs | H05K 5/0217 361/749 |
| 2015/0070228 | A1 | 3/2015 | Gu et al. | |
| 2016/0056544 | A1 | 2/2016 | Garcia et al. | |
| 2016/0276734 | A1 | 9/2016 | Jin et al. | |
| 2017/0194271 | A1 | 7/2017 | Hsu et al. | |
| 2017/0309582 | A1 | 10/2017 | Meyer et al. | |
| 2017/0317418 | A1 | 11/2017 | Garcia et al. | |
| 2018/0013191 | A1* | 1/2018 | Cameron | H01Q 17/007 |
| 2018/0026341 | A1* | 1/2018 | Mow | H04B 10/90 343/702 |
| 2018/0108624 | A1 | 4/2018 | Hsu et al. | |
| 2018/0131087 | A1* | 5/2018 | Kim | H01Q 1/48 |
| 2019/0074576 | A1* | 3/2019 | Bae | H01Q 13/10 |
| 2019/0098750 | A1* | 3/2019 | Woo | H05K 1/0236 |
| 2019/0104212 | A1* | 4/2019 | Lee | H01Q 1/243 |
| 2019/0115646 | A1* | 4/2019 | Chiu | H01Q 15/10 |
| 2019/0198976 | A1* | 6/2019 | Kim | H01Q 1/243 |
| 2019/0198995 | A1* | 6/2019 | Ryoo | H01Q 9/42 |
| 2019/0312334 | A1* | 10/2019 | Shin | H01Q 9/0407 |
| 2019/0348748 | A1* | 11/2019 | Liu | H01Q 9/0407 |
| 2020/0014095 | A1 | 1/2020 | Mow et al. | |
| 2020/0076055 | A1* | 3/2020 | Jeon | H01Q 1/38 |
| 2020/0135670 | A1* | 4/2020 | Hsu | H01L 24/19 |
| 2020/0185299 | A1* | 6/2020 | Chang | H01L 24/19 |

* cited by examiner

530: 231, 232, 233, 234
540: 541, 542, 543, 544
550: 551, 552, 553, 554
570: 571

[FIRST ANTENNA]

farfield (f=28) [8]

| | |
|---|---|
| Type | Farfield |
| Approximation | enabled (kR>>1) |
| Component | Abs |
| Output | Realized Gain |
| Frequency | 28 Ghz |
| Rad. effic | -1.245dB |
| Tot. effic | -1.736dB |
| rlzd. Gain | 1.983dB |

<711>

[FIRST ANTENNA]

farfield (f=28) [8]

| | |
|---|---|
| Type | Farfield |
| Approximation | enabled (kR>>1) |
| Component | Abs |
| Output | Realized Gain |
| Frequency | 28 Ghz |
| Rad. effic | -1.283dB |
| Tot. effic | -2.662dB |
| rlzd. Gain | **2.071dB** |

<712>

<721>

<722>

<731>

<732>

<741>

<742>

940: 941, 942, 943, 944
950: 951, 952, 953, 954
970: 971

ANTENNA MODULE AND ELECTRONIC DEVICE COMPRISING THE SAME

CROSS-REFERENCE TO RELATED APPLICATION(S)

This application is based on and claims priority under 35 U.S.C. § 119 to Korean Patent Application No. 10-2018-0157331, filed on Dec. 7, 2018, in the Korean Intellectual Property Office, the disclosure of which is incorporated by reference herein its entirety.

BACKGROUND

1. Field

The disclosure relates to an antenna module and an electronic device including the antenna module.

2. Description of Related Art

An electronic device may include a communication module (hereinafter referred to as an "antenna module") in which an antenna is embedded and may communicate with a base station or another electronic device by using the antenna module. The antenna module may include an antenna (e.g., a patch antenna) and an electronic component (e.g., a communication circuit) for transmitting/receiving a high-frequency signal with the antenna. It is important to prevent the antenna from interfering with the other electronics of the electronic device.

The above information is presented as background information only to assist with an understanding of the disclosure. No determination has been made, and no assertion is made, as to whether any of the above might be applicable as prior art with regard to the disclosure.

SUMMARY

In accordance with an aspect of the disclosure, an antenna module comprises a printed circuit board; a communication circuit disposed on a first surface of the printed circuit board; an array antenna configured to transmit/receive a signal in a specified high-frequency band with the communication circuit, wherein the array antenna includes: first conductive elements disposed on the first surface of the printed circuit board, and second conductive elements disposed on a second surface facing the first conductive elements; and a first molding layer covering the first conductive elements.

In accordance with another aspect of the disclosure, an electronic device comprises an antenna module; and a processor electrically connected with the antenna module, and configured to transmit/receive a specified high-frequency signal by using the antenna module, wherein the antenna module includes: a printed circuit board; a communication circuit disposed on a first surface of the printed circuit board; an array antenna configured to transmit and receive a signal in a frequency band exceeding 3 GHz with the communication circuit based on a command of the processor, wherein the array antenna includes first conductive elements formed on the first surface of the printed circuit board and second conductive elements formed on a second surface of the printed circuit board facing the first conductive elements; and a first molding layer covering the first conductive elements.

In accordance with another aspect of the disclosure, an antenna module comprises a printed circuit board; a communication circuit disposed on a first surface of the printed circuit board; an array antenna configured to transmit/receive a signal in a specified high-frequency band with the communication circuit, wherein the array antenna includes first conductive elements disposed on a first layer of the printed circuit board; and a first molding layer covering at least a part of the first conductive elements, when viewed from above a first surface of the printed circuit board.

Other aspects, advantages, and salient features of the disclosure will become apparent to those skilled in the art from the following detailed description, which, taken in conjunction with the annexed drawings, discloses certain embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

With regard to description of drawings, similar components may be marked by similar reference numerals.

DETAILED DESCRIPTION

A region of the antenna module, in which the electronic component is mounted, may be shielded such that electromagnetic waves of the electronic component have no, limited, or reduced influence on another circuitry (e.g., a processor). For example, the electronic component of the antenna module may be shielded as being molded with a synthetic resin (e.g., epoxy) and applied by a metallic compound.

However, because the electronic component and the patch antenna are disposed adjacent to each other, the resin used in a molding process may overflow into an antenna region, and thus, the resin may cover a portion of the patch antenna unevenly. The mold covering the patch antenna may change a dielectric coefficient of an antenna, which has an influence on a characteristic (e.g., directivity) of the antenna. In addition, it is difficult to completely remove the mold covering the antenna through grinding.

Aspects of the disclosure may address at least the above-mentioned problems and/or disadvantages and to provide at least the advantages described below. Accordingly, an aspect of the disclosure may provide an antenna module capable of improving a gain by applying a molding layer and an electronic device including the antenna module.

Figure 1:
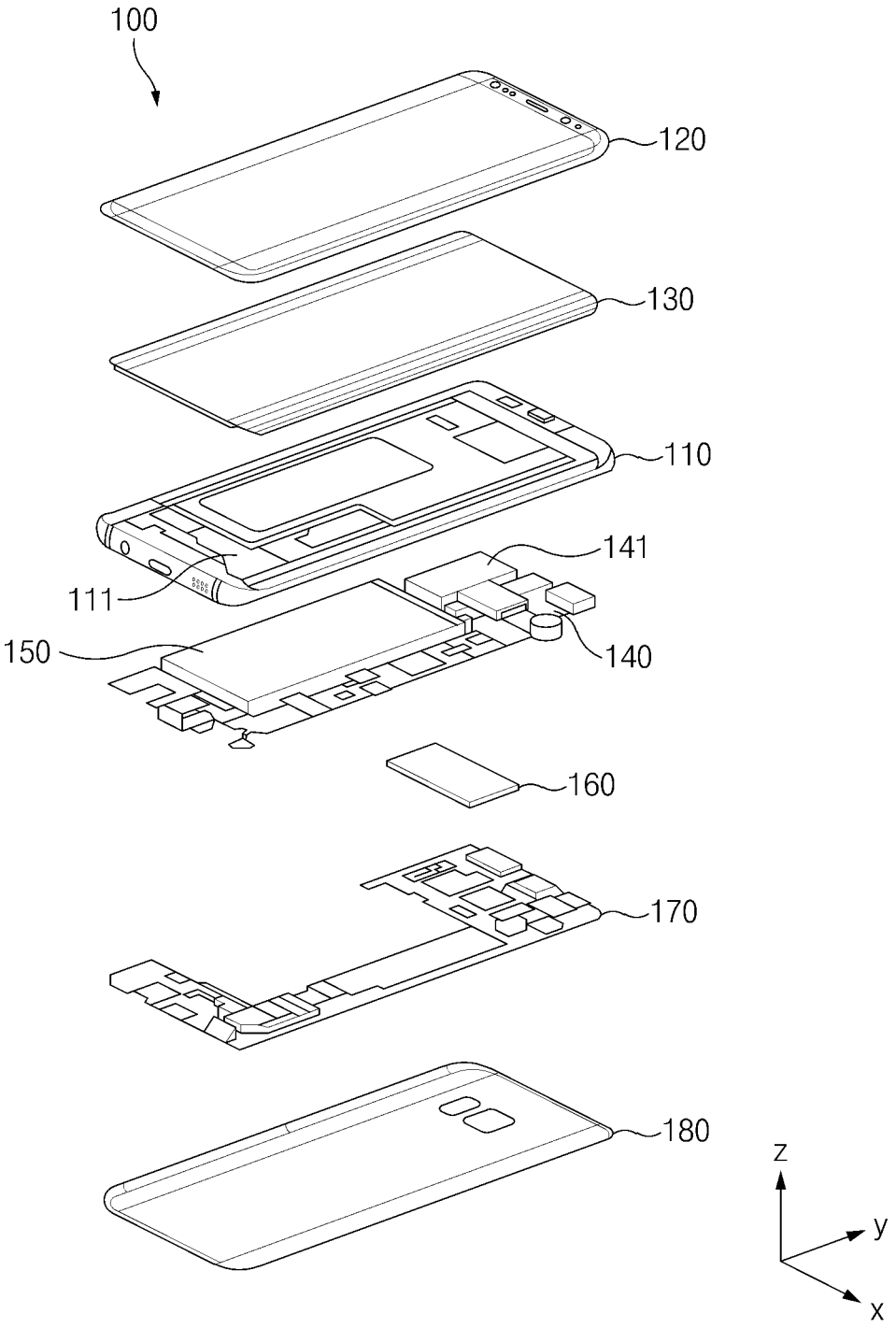
FIG. 1 is an exploded perspective view of an electronic device according to an embodiment.

FIG. 1 is an exploded perspective view of an electronic device according to an embodiment.

Referring to FIG. 1, an electronic device 100 may include a side bezel structure 110, a first support member 111 (e.g., a bracket), a front plate 120, a display 130, a printed circuit board (PCB) 140, a battery 150, an antenna module 160, a second support member 170 (e.g., a rear case), and a back plate 180. In an embodiment, the electronic device 100 may not include a part (e.g., the first support member 111 or the second support member 170) of the components illustrated in FIG. 1 or may further include any other component not illustrated in FIG. 1.

The side bezel structure 110 may be coupled to the front plate 120 and the back plate 180 to form a housing of the electronic device 100. The housing may form the exterior of the electronic device 100 and may protect components disposed within the electronic device 100 against an external environment (e.g., moisture or impact).

The side bezel structure 110 may form a side surface (or a side member) of the housing together with a portion of the front plate 120 and/or a portion of the back plate 180. The side surface may be understood as a region that surrounds a space between a first surface on which the front plate 120 is disposed and a second surface on which the back plate 180 is disposed. The side surface of the housing may have substantially a quadrangle, for example, a shape having four corners to be identical or similar to a rectangle or a rounded rectangle.

The first support member 111 may be disposed within the electronic device 100 so as to be connected with the side bezel structure 110 or may be integrally formed with the side bezel structure 110. In an embodiment, the first support member 111 may support or fix electronic components disposed within the electronic device 100, for example, the printed circuit board 140, an electronic component disposed on the printed circuit board 140, or various kinds of modules (e.g., the antenna module 160) performing various functions on a side of the front plate 120.

The front plate 120 may be coupled to the side bezel structure 110 and the back plate 180 to form the housing. In an embodiment, the front plate 120 may protect an internal component of the electronic device 100, for example, the display 130 against impact coming from a front surface of the electronic device 100. According to certain embodiments, the front plate 120 may transmit a light generated from the display 130 or a light incident onto various kinds of sensors (e.g., an image sensor, an iris sensor, a proximity sensor, or the like) disposed on the front surface of the electronic device 100.

The display 130 may be disposed adjacent to one surface of the front plate 120. According to certain embodiments, the display 130 may be electrically connected with the printed circuit board 140 to output content (e.g., a text, an image, a video, an icon, a widget, or a symbol) or to receive a touch input (e.g., a touch, a gesture, or a hovering) from the user.

Various electronic components, various elements, or various printed circuits of the electronic device 100 may be mounted on the printed circuit board 140. For example, an application processor (AP), a communication processor (CP), or an intermediate frequency integrated circuit (IF IC) may be mounted on the printed circuit board 140.

The battery 150 may convert chemical energy and electrical energy bidirectionally. For example, the battery 150 may convert chemical energy into electrical energy and may supply the converted electrical energy to the display 130 and various components or modules mounted on the printed circuit board 140. According to an embodiment, a power management module for managing the charging and discharging of the battery 150 may be included in the printed circuit board 140.

The antenna module 160 (or an antenna device or an antenna circuit) may be disposed adjacent to the printed circuit board 140. For example, the antenna module 160 may be physically connected with at least a portion of the printed circuit board 140. For another example, the antenna module 160 may be disposed adjacent to the printed circuit board 140, and may be electrically connected with electronic components disposed on the printed circuit board 140, for example, a communication module, one or more processors 141, such as a communication processor, or an application processor.

To allow the electronic device 100 to electronically communicate with other electronic devices 100 and/or a cellular network, the electronic device 100 includes the antenna module 160. The antenna module 160 may be a module for communicating with a base station or another electronic device by using a millimeter wave signal. In the specification, the millimeter wave signal may include, for example, a radio frequency (RF) signal in at least a portion of a frequency band ranging from 3 GHz to 300 GHz.

The antenna module 160 may include a plurality of antenna elements. At least some of the plurality of antenna elements may form an array antenna. For example, at least some of the plurality of antenna elements may be arranged in a line to form an array antenna of a 1×n (or n×1) form. For another example, at least some of the plurality of antenna elements may be arranged in the shape of a circle or rectangle to form an array antenna of an n×m form. According to certain embodiments, the antenna module 160 may include a plurality of array antennas forming beams in different directions, and the plurality of array antennas may share at least one antenna element. Because the at least one antenna element is shared by the plurality of array antennas, the size of the antenna module 160 may decrease. In the specification, an antenna element may be referred to as a "conductive element".

According to an embodiment, each of the array antennas may form at least one beam for transmitting or receiving a millimeter wave signal. According to certain embodiments, a shape of the at least one beam thus formed may vary depending on an array antenna. For example, the at least one beam thus formed may have a different direction or size based on a kind of antenna elements included in an array antenna, a shape in which the antenna elements are arranged, or a direction in which the antenna elements are arranged. The electronic device 100 may perform millimeter wave communication with base stations or other electronic devices placed in various directions around the electronic device 100 by using the beams formed in the different shapes.

In certain embodiments, the antenna module is shielded such that interference by electromagnetics waves to other electronic circuitry is prevented or reduced.

The antenna module 160 may be disposed adjacent to a periphery of the electronic device 100, for example, at least a portion of the side surface of the housing. For example, in the case where the housing is formed in the shape of a quadrangle or substantially a quadrangle as illustrated in FIG. 1, the antenna module 160 may be disposed adjacent to one of corners of the side surface of the housing.

Unlike the example illustrated in FIG. 1, the electronic device 100 may include two or more antenna modules 160. For example, the electronic device 100 may include a first antenna module and a second antenna module. In an embodiment, the first antenna module may be disposed adjacent to a first corner of the side surface, and the second antenna module may be disposed adjacent to a second corner different from the second corner.

According to certain embodiments, a location where the antenna module 160 is disposed is not limited to FIG. 1. For example, the antenna module 160 may be interposed between the printed circuit board 140 and the second support member 170 as illustrated in FIG. 1 or may be interposed between the second support member 170 and the back plate 180 unlike the example illustrated in FIG. 1. For another example, the antenna module 160 may be disposed on the same plane as the second support member 170.

The second support member 170 may be interposed between the back plate 180 and the printed circuit board 140. According to an embodiment, to be identical or similar to the first support member 111, the second support member 170 may support or fix the electronic components in the electronic device 100 on a side of the back plate 180.

The back plate 180 may be coupled to the side bezel structure 110 and the front plate 120 to form the housing. In an embodiment, the back plate 180 may protect internal components of the electronic device 100 against impact coming from the back surface of the electronic device 100.

Figure 2A:
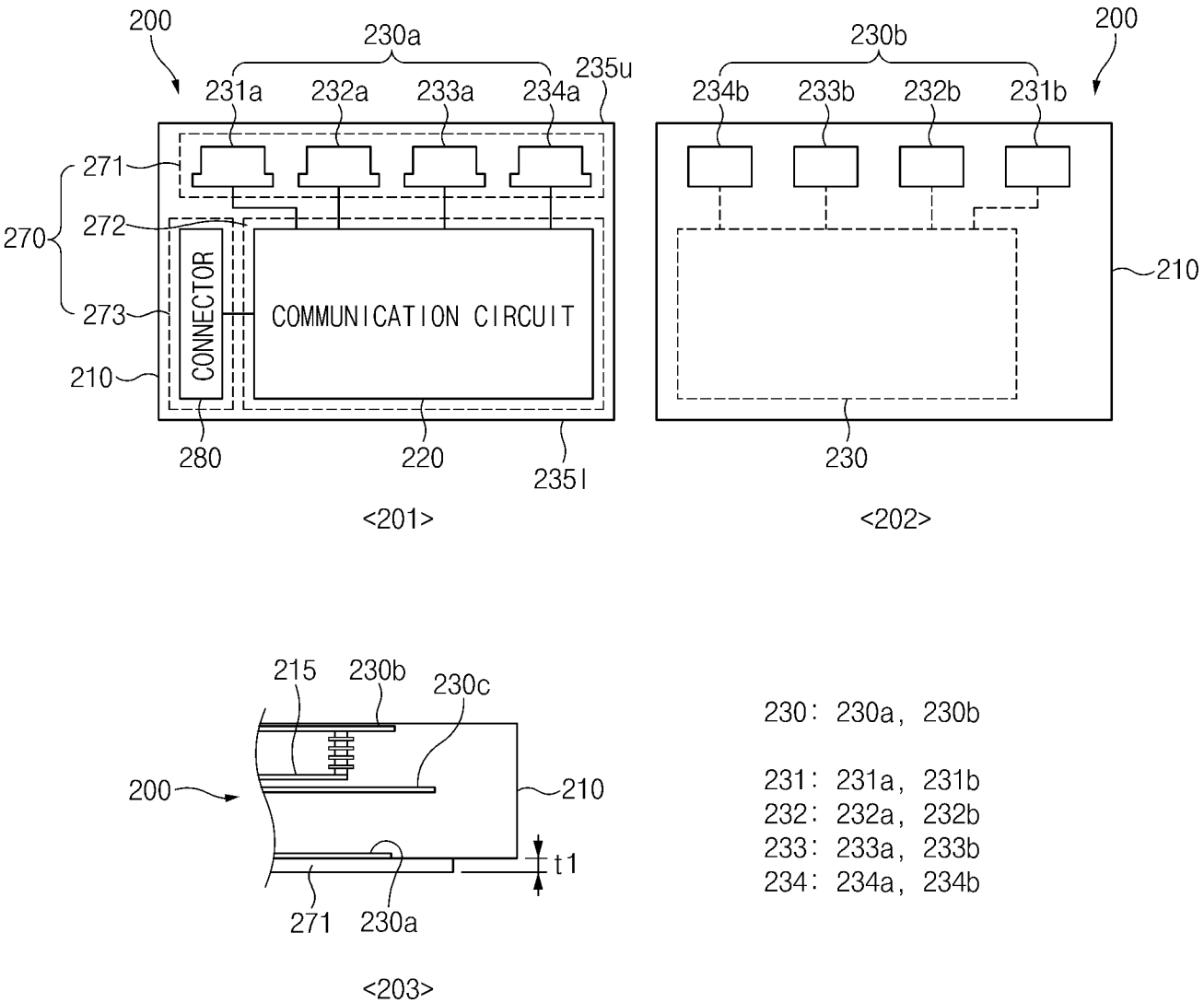
FIG. 2A illustrates an example of an antenna module according to an embodiment.
Figure 2B:
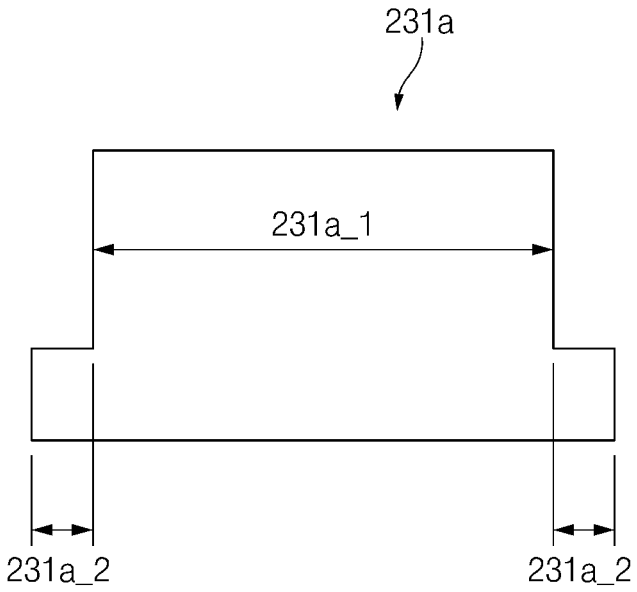
FIG. 2B illustrates a first conductive element belonging to an array antenna of an antenna module according to an embodiment.

FIG. 2A illustrates an example of an antenna module according to an embodiment, and FIG. 2B illustrates a first conductive element belonging to an array antenna of an antenna module according to an embodiment.

Referring to FIGS. 2A and 2B, an antenna module 200 (e.g., the antenna module 160 of FIG. 1) (or an antenna device) according to an embodiment may include a printed circuit board 210, a communication circuit 220, and an array antenna 230. In an embodiment, the antenna module 200 may not include some of the above components or may further include any other components. For example, the antenna module 200 may further include a connector 280. In an embodiment, some of the components of the antenna module 200 may be combined to form one entity, which may identically perform functions of the some components before the combination. In FIG. 2A, the antenna module has a first surface <201>, and a second surface <202> of the antenna module 200. Reference <203> is a view of the antenna module 200 from the side.

According to an embodiment, the printed circuit board 210 may at least include a first layer, a second layer, and a third layer. The first layer may form the first surface (e.g., a top surface) 201 of the printed circuit board 210, and the second layer may form the second surface (e.g., a bottom surface) 202 of the printed circuit board 210. The third layer may be an inner layer formed between the first layer and the second layer of the printed circuit board 210. The printed circuit board 210 may be designed with a low-loss printed circuit board appropriate to transmit/receive a high-frequency signal.

According to an embodiment, the communication circuit 220 may be disposed (or mounted) on the first surface 201 of the printed circuit board 210 and may be electrically connected with each of antennas 231, 232, 233, and 234 belonging to the array antenna 230. The communication circuit 220 may include a plurality of electronic components. The communication circuit 220 may transmit/receive a specified high-frequency signal with each of the antennas 231, 232, 233, and 234. The specified high-frequency signal may include, for example, a signal in at least a portion (e.g., 28 GHz or 39 GHz) of a frequency band ranging from 3 GHz to 300 GHz.

According to an embodiment, the array antenna 230 may be formed adjacent to a first side (e.g., an upper side 235*u*) of the printed circuit board 210. The array antenna 230 may radiate a beam by using a specified direction between a first axis passing through the center of the printed circuit board 210 and facing the upper side 235*u* from a lower side surface 2351 of the printed circuit board 210 and a second axis passing through the center of the printed circuit board 210 and facing the second surface 202 from the first surface 201 (through the plane of the paper) of the printed circuit board 210 as a main direction (e.g., such that a main lobe faces the specified direction). The specified direction may be, for example, a direction, which forms a specified angle (e.g., 45 degrees) with the first axis, on the plane defined by the first axis and the second axis. The performance of the array antenna 230 may vary depending on a thickness and a shape of a molding layers 270, for example.

The array antenna 230 may include the four antennas 231, 232, 233, and 234, but is not limited to four, and may include more than four or less than four in other embodiments. In the specification, the case where the array antenna 230 includes the first to fourth antennas 231, 232, 233, and 234 will be described as an example. Each of the first to fourth antennas 231, 232, 233, and 234 may include a pair of first and second conductive elements facing each other. The first antenna 231 may include a pair of first and second conductive elements 231*a* and 231*b* facing each other, the second antenna 232 may include a pair of first and second conductive elements 232*a* and 232*b* facing each other, the third antenna 233 may include a pair of first and second conductive elements 233*a* and 233*b* facing each other, and the fourth antenna 234 may include a pair of first and second conductive elements 234*a* and 234*b* facing each other. The first conductive elements 230*a* formed on the first surface 201 of the printed circuit board 210 may be connected with a ground of the communication circuit 220. The second conductive elements 230*b* formed on the second surface 202 of the printed circuit board 210 may be electrically connected with first feeding nodes 215 of the communication circuit 220. Each of the first conductive elements 230*a* and the second conductive elements 231*b*, 232*b*, 233*b*, 234*b* may be, for example, a patch antenna. Shapes and sizes of the first conductive elements 230*a* and the second conductive elements 231*b*, 232*b*, 233*b*, 234*b* may be determined depending on characteristics (e.g., a frequency and a phase) of signals that are transmitted/received by the first to fourth antennas 231, 232, 233, and 234.

The first to fourth antennas 231, 232, 233, and 234 belonging to the array antenna 230 may be impedance matched by using at least one of the first conductive elements 230*a* and third conductive elements 230*c*. For example, referring to FIG. 2B, the first conductive elements (e.g., 231*a*) may include a first portion 231*a*_1 overlapping the second conductive elements (e.g., 231*b*) and a second portion 231*a*_2 protruding out of the second conductive elements (e.g., 231*b*), when viewed from above the second surface 202 of the printed circuit board 210. The second portion (e.g., 231*a*_2) of each of the second conductive elements (e.g., 231*b*) may be used for impedance matching of each of the first to fourth antennas (e.g., the first antenna 231). For another example, referring to state <203> of FIG. 2A, the third conductive elements 230*c* may be provided at the inner layer (e.g., the third layer) of the printed circuit board 210 between the first conductive elements 230*a* and the second conductive elements 230*b* as much as the number of the first conductive elements 230*a* or the second conductive elements 230*b*. The third conductive elements 230*c* may be used for impedance matching of the first to fourth antennas 231, 232, 233, and 234.

According to an embodiment, the molding layers 270 on the first surface 201 may cover at least the array antenna 230 and the communication circuit 220. The molding layers 270 may include a first molding layer 271 covering the first conductive elements 230*a* and a second molding layer 272 covering the communication circuit 220. The molding layers 270 may be formed by a molding process, for example, using an epoxy resin. According to certain embodiments, the molding layers 270 may further a third molding layer 273 covering a surrounding portion of the connector 280.

According to an embodiment, the first molding layer 271 may a first thickness. The first thickness may be between approximately 100 μm to approximately 170 μm. The first thickness may vary depending on a characteristic of a high-frequency signal that is transmitted/received by the array antenna 230.

According to an embodiment, the first molding layer 271 may be provided in various shapes. For example, the first molding layer 271 may be provided in a specified shape covering all the first conductive elements 230*a*. The specified shape may be, for example, a shape of one rectangle or a shape in which two or more rectangles are connected. For another example, the first molding layer 271 may be provided to correspond to a shape of the first conductive elements 230*a*. For another example, the first molding layer 271 may be provided to cover the first conductive elements 230*a*, with at least one conductive element of the first conductive elements 230*a* spaced from the remaining conductive elements as much as a specified gap (or distance).

According to an embodiment, the first molding layer 271 may be provided such that the first to fourth antennas 231, 232, 233, and 234 belonging to the array antenna 230 have a specified characteristic. For example, the first molding layer 271 may be provided such that a gain difference between the first to fourth antennas 231, 232, 233, and 234 is within a specified range (e.g., 0.5 dBi) and the total gain of the array antenna 230 is 8 dBi or greater. The total gain may be, for example, a gain of the array antenna 230 when the first to fourth antennas 231, 232, 233, and 234 belonging to the array antenna 230 radiate high-frequency signals.

According to an embodiment, the second molding layer 272 may have thickest ("second thickness") electronic components included in the communication circuit 220. The second molding layer 272 may be covered by a metallic compound so as to be shielded. For example, the second molding layer 272 may be shielded by applying the metallic compound on the second molding layer 272 through a shielding process and hardening the metallic compound.

According to an embodiment, the third molding layer 273 may be thinner than the first molding layer 271. The thickness of the third molding layer 273 ("third thickness") may be a thickness that makes it possible to expose pads that are electrically connected with the connector 280 and formed on the first surface 201 of the printed circuit board 210. In an embodiment, the third molding layer 273 may be omitted. For example, in the case where the antenna module 200 does not include the connector 280, the third molding layer 273 may not exist.

According to an embodiment, the connector 280 may be mounted on the first surface 201 of the printed circuit board 210 and may electrically connect the printed circuit board 210 and any other printed circuit board (e.g., the printed circuit board 140 of FIG. 1) on which a processor (e.g., a processor 141) is mounted. In the case where the printed circuit board 140 and the printed circuit board 210 are electrically connected by the connector 280, the communication circuit 220 may be electrically connected with the processor 141 and may transmit/receive a high-frequency signal with the array antenna 230 under control of the processor 141.

According to certain embodiments, another communication circuit (not illustrated) may be further included between the processor 141 and the communication circuit 220. The another communication circuit may convert a baseband signal received from the processor 141 into an intermediate frequency signal (e.g., 9 GHz to approximately 11 GHz) or may convert an intermediate frequency signal from the communication circuit 220 into a baseband signal. The communication circuit 220 may convert an intermediate frequency signal received from the other communication circuit into a high-frequency signal or may convert a high-frequency signal received from the array antenna 230 into an intermediate frequency signal.

The embodiments are described above under the condition that the array antenna 230 is implemented on the first surface 201 and the second surface 202 of the printed circuit board 210. However, the disclosure is not limited thereto. For example, at least a portion (e.g., the first conductive elements (e.g., 231*a*) and the second conductive elements (e.g., 230*b*)) of the array antenna 230 may be disposed in the inner layer of the printed circuit board 210.

According to the above embodiment, the antenna module 200 may improve the performance of the array antenna 230 by solving an issue that a characteristic of the array antenna 230 is affected due to a molding process for the communication circuit 220 and gathering beams radiated from the array antenna 230 by using the molding layers 270 (e.g., a dielectric substance of the molding layers 270).

Also, according to the above embodiment, in the case of adding the first molding layer 271 for improving the performance of the array antenna 230 on the first surface 201 of the printed circuit board 210 where the communication circuit 220 is mounted, because the first molding layer 271 is lower in height than the communication circuit 220, the first molding layer 271 may have no influence on a substantial thickness of the antenna module 200.

According to an embodiment, an antenna module (e.g., the antenna module 200 of FIG. 2A) may include a printed circuit board (e.g., the printed circuit board 210 of FIG. 2A), a communication circuit (e.g., the communication circuit 220 of FIG. 2A) disposed on a first surface 201 of the printed circuit board, an array antenna (e.g., the array antenna (230*a*, 230*b*) of FIG. 2A) that transmits/receives a signal in a specified high-frequency band with the communication circuit, wherein the array antenna includes first conductive elements (e.g., the first conductive elements 230*a* of FIG. 2A) formed on the first surface 201 of the printed circuit board and second conductive elements (e.g., the second conductive elements 230*b* of FIG. 2A) formed on a second surface 202 so as to face the first conductive elements, and a first molding layer that is formed above the first surface 201 of the printed circuit board so as to cover the first conductive elements.

The first molding layer may have a thickness between 100 μm to 170 μm.

The first molding layer may be provided such that antennas belonging to the array antenna have a specified characteristic.

The first molding layer have shape covering all the first conductive elements.

The shape may be a shape of one rectangle (or rectangular shape) or a shape in which two or more rectangles (rectangular shapes) are connected.

The first molding layer correspond to a shape of the first conductive elements.

The first molding layer may cover the first conductive elements, with at least one conductive element of the first conductive elements spaced from the remaining conductive elements thereof as much as a specified gap.

The antenna module may further include a second molding layer (e.g., the second molding layer 272 of FIG. 2A) covering the communication circuit, and the second molding layer may be covered by a metallic compound.

When viewed from above the second surface of the printed circuit board, the first conductive elements may be provided to respectively face the second conductive elements so as to be paired.

The array antenna may be provided to radiate a beam by using a direction, which forms a specified angle with an axis passing through a center of the first printed circuit board and facing the second surface from the first surface of the first printed circuit board, as a main direction.

Figure 3A:
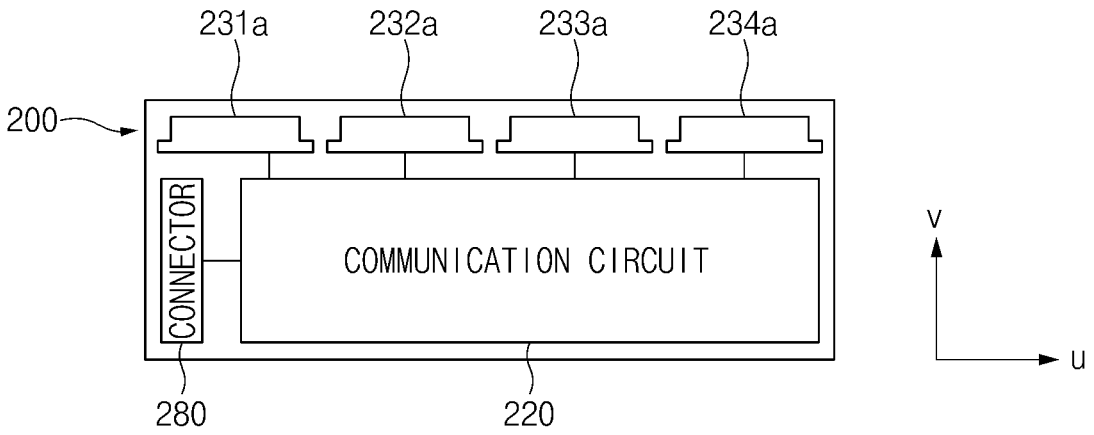
FIG. 3A illustrates a first surface of an antenna module in which a first molding layer according to an embodiment is not formed.

FIG. 3A illustrates a first surface of an antenna module without a first molding layer according to an embodiment, and FIGS. 3B to 3E illustrate a first surface of an antenna module in which a first molding layer is formed. The case where the first molding layer 271 is provided in a state where the communication circuit 220 and the connector 280 are not mounted on the printed circuit board 210 is illustrated in FIGS. 3B to 3E as an example.

Figure 3B:
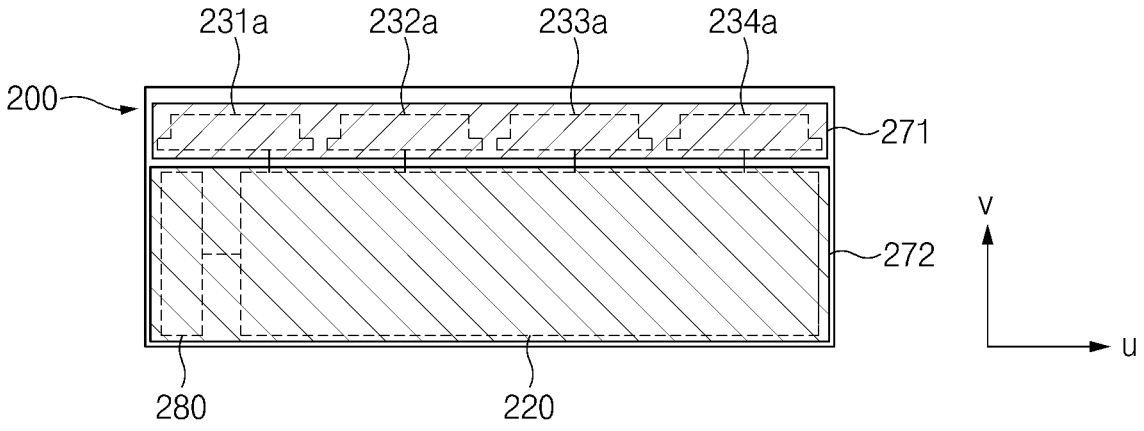
FIGS. 3B to 3E illustrate a first surface of an antenna module in which a first molding layer is formed.
Figure 3C:
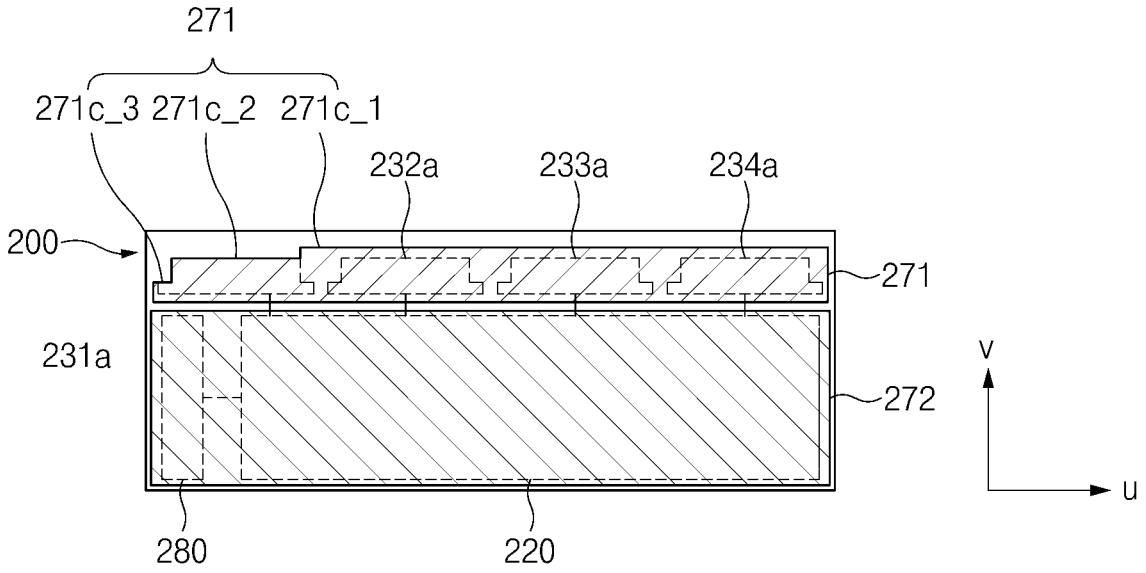
Figure 3D:
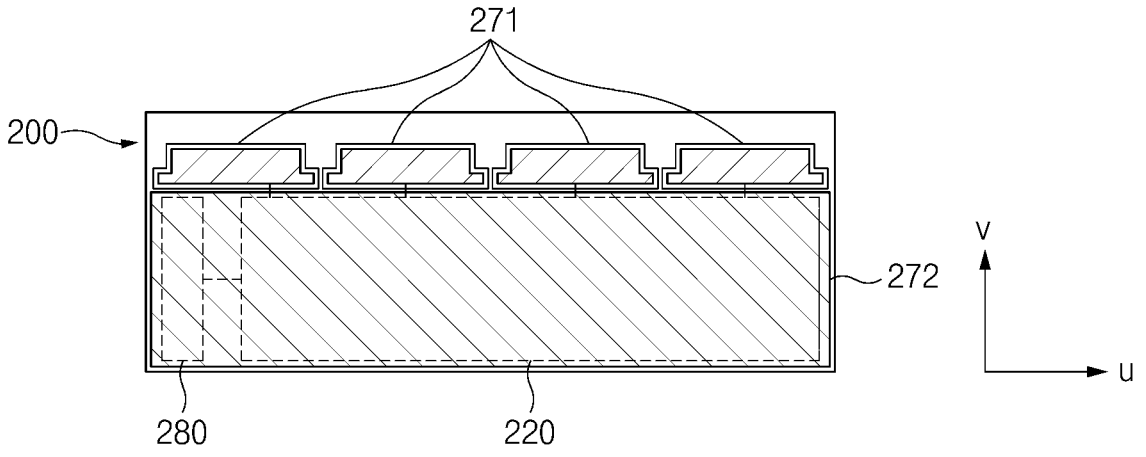
Figure 3E:
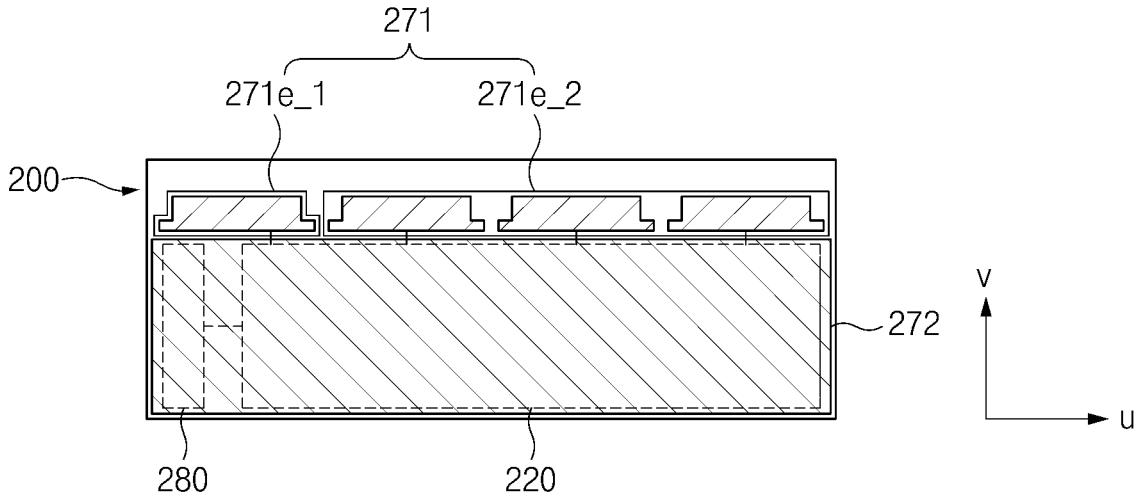

FIG. 3B shows the first molding layer 271 covering the antenna elements 231*a*, 232*a*, 233*a*, and 234*a*. FIG. 3C shows the first molding layer 271 covering the antennas 232*a*, 233*a*, and 234*a* and corresponding to an outline of antenna 231*a*. FIG. 3D includes the molding layer 271 covering antennas 231*a*, 232*a*, 233*a*, and 234*a* and corresponding to their shapes. FIG. 3E shows the first molding layer 271 covering antenna 232*a*, 233*a*, and 234*a* and corresponding to the shape of antenna 231*a*.

Referring to FIGS. 3B and 3C, the first molding layer 271 may be provided in a specified shape covering all the first conductive elements 230*a*. As illustrated in FIG. 3B, the specified shape may be a shape of one rectangle. Alternatively, as illustrated in FIG. 3C, the specified shape may be a shape where two or more rectangles 271*c*_1, 271*c*_2, and 271*c*_3 are connected.

Referring to FIG. 3D, the first molding layer 271 may be provided to correspond to a shape of the first conductive elements 230*a*. Referring to FIG. 3A, each of the first conductive elements (e.g., 231*a*) may be provided in a shape (hereinafter referred to as a "hat shape") where a lower left end and a lower right end of a rectangle protrude. In this case, referring to FIG. 3D, the first molding layer 271 may be provided in a plurality of hat shapes (i.e., a shape of the first molding layer 271), which are spaced from each other as much as a gap.

Referring to FIG. 3E, the first molding layer 271 may be provided to cover the first conductive elements 230*a*, with at least one conductive element 231*a* of the first conductive elements 230*a* spaced from the remaining conductive elements 232*a*, 233*a*, and 234*a* as much as a specified gap. For example, the first molding layer 271 may include a portion 271*e*_1 covering the at least one conductive element 231*a* and a portion 271*e*_2 covering the remaining conductive elements 232*a*, 233*a*, and 234*a*. The portion 271*e*_1 covering the at least one conductive element 231*a* may be provided in a shape (e.g., a hat shape) corresponding to the first conductive element 231*a*, and the portion 271*e*_2 covering the remaining conductive elements 232*a*, 233*a*, and 234*a* may be provided in the shape of a quadrangle.

A characteristic of the array antenna 230 to which the first molding layer 271 according to FIGS. 3A to 3E is applied will be described with reference to Table 1 below. In Table 1 below, φ may be an angle that a main lobe of a beam of the array antenna 230 forms with a first axis.

In Table 1 below, even though gains change somewhat depending on a shape of the first molding layer 271, it may be observed that gains of the first to fourth antennas 231, 232, 233, and 234 belonging to the array antenna 230 when the array antenna 230 is covered by the first molding layer 271 (refer to third to sixth rows in Table 1) increase compared to when the array antenna 230 is not covered by the first molding layer 271 (refer to a second row in Table 1).

Also, in Table 1 below, it may be observed that the total gain (φ=0) of the array antenna 230 when the array antenna 230 is covered by the first molding layer 271 (refer to the third to sixth rows in Table 1) is improved compared to when the array antenna 230 is not covered by the first molding layer 271 (refer to the second row in Table 1). In addition, in Table 1 below, it may be observed that the total gain (φ=30 or 45) of the array antenna 230 is improved even in the case of changing directivity of the array antenna 230. The directivity may be changed, for example, by adjusting phases of high-frequency signals that are transmitted by the first to fourth antennas 231, 232, 233, and 234 belonging to the array antenna 230.

TABLE 1

| Shape (referred to by FIG.) | Individual gain (dBi) | | | | Total gain (dBi) | | |
|---|---|---|---|---|---|---|---|
| | 1st ANT 231 | 2nd ANT 232 | 3rd ANT 233 | 4th ANT 234 | φ = 0° | Φ = 30° | φ = 45° |
| 3A | 1.94 | 1.81 | 1.82 | 1.98 | 7.42 | 7.46 | 7.49 |
| 3B | 3.32 | 3.16 | 2.49 | 2.07 | 8.05 | 8.12 | 8.099 |

TABLE 1-continued

| Shape (referred to by FIG.) | Individual gain (dBi) 1st ANT 231 | 2nd ANT 232 | 3rd ANT 233 | 4th ANT 234 | Total gain (dBi) φ = 0° | Φ = 30° | φ = 45° |
|---|---|---|---|---|---|---|---|
| 3C | 3.74 | 3.5 | 2.53 | 1.88 | 8.31 | 8.3 | 8.49 |
| 3D | 2.72 | 2.77 | 2.33 | 2.48 | 8.19 | 8.12 | 8.1 |
| 3E | 3.72 | 3.47 | 2.62 | 1.86 | 8.25 | 8.3 | 8.38 |

Figure 4:
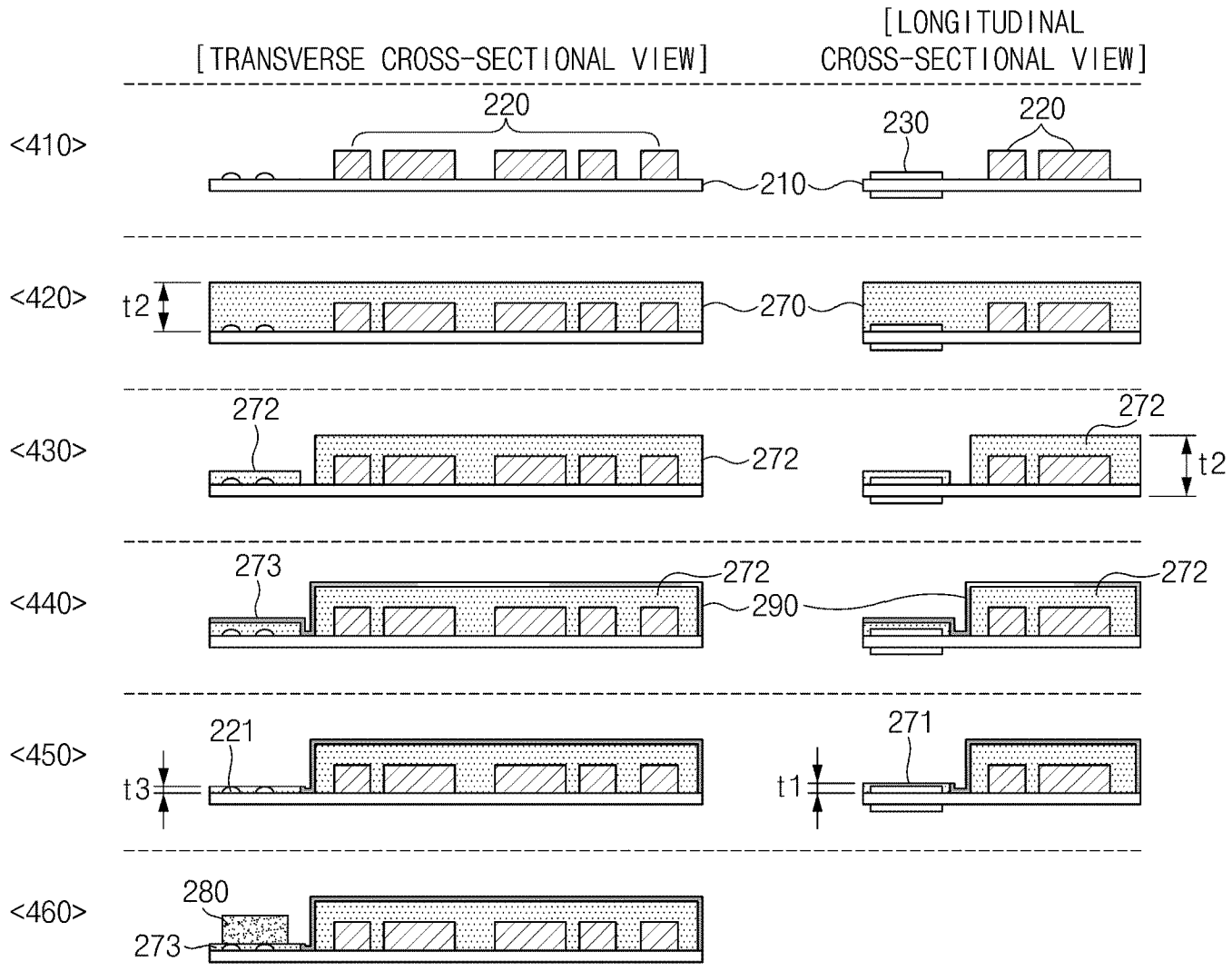
FIG. 4 illustrates horizontal cross-sectional views and vertical cross-sectional views of an antenna module after each manufacturing process, according to an embodiment.

FIG. 4 illustrates horizontal cross-sectional views and vertical cross-sectional views of an antenna module after each manufacturing process, according to an embodiment.

Referring to FIG. 4, in state 410, the communication circuit 220 may be mounted on a first surface of the antenna module 200 (e.g., a first surface of the printed circuit board 210) through a surface mount technology (SMT) process.

In state 420, the molding layers 270 having a second specified thickness t2 may be formed on the first surface of the printed circuit board 210 through a molding layer.

In state 430, as the molding layer (i.e., the molding layers 270 in FIG. 2A) is ground through a grinding process, the first molding layer 271, the second molding layer 272, and the third molding layer 273 may be formed. Also, gaps may be formed between the first molding layer 271 and the second molding layer 272 and between the second molding layer 272 and the third molding layer 273 through a laser grooving process. In state 430, because not ground, the second molding layer 272 may be provided to have a second specified thickness t2.

In state 440, a shield layer 290 may be formed by applying a metallic compound on the first surface of the antenna module 200 through a shielding process. Due to the gap between the first molding layer 271 and the second molding layer 272 and the gap between the second molding layer 272 and the third molding layer 273, the second molding layer 272 may be separated from the first molding layer 271 and the third molding layer 273 and may be shielded.

In state 450, the shield layer 290 on the first molding layer 271 and the third molding layer 273 may be ground through a grinding process. As such, the first molding layer 271 may be provided to have a first specified thickness t1, and the third molding layer 273 may be provided to have a third specified thickness. The first specified thickness t1 may be determined, for example, to improve a characteristic (e.g., a gain) of the array antenna 230 and may include, for example, a thickness between approximately 100 μm to approximately 170 μm. The third specified thickness t3 may be a thickness that allows pads 221 to be exposed to such an extent as not to be damaged. In an embodiment, the third molding layer 273 may be completely omitted through a grinding process.

In state 460, the connector 280 may be mounted on the third molding layer 273, and the pads 221 formed on the first surface of the printed circuit board 210 and the connector 280 may be joined together through a soldering process.

According to the above embodiment, by changing a portion of an existing manufacturing process, the antenna module 200 may solve an issue of affecting a characteristic of the array antenna 230 in a molding process and may also improve the performance of the array antenna 230.

A characteristic (e.g., the degree of roughness, a density, or a dielectric coefficient) of the first molding layer 271 after the above processes may vary depending on a process variation. However, in Table 2 below, it is understood that a characteristic (e.g., a dielectric coefficient, dielectric loss, conductivity) of the first molding layer 271 affecting the performance of the array antenna 230 is not almost varied. Accordingly, it may be predicted that the first molding layer 271 improves the performance of the array antenna 230 evenly.

TABLE 2

| Classification | Frequency | Dielectric coefficient | Dielectric loss | conductivity |
|---|---|---|---|---|
| Rough surface | 28 GHz | 3.35 | 0.0109 | 0.0572 |
| | 39 GHz | 3.34 | 0.0146 | 0.1061 |
| Smooth surface | 28 GHz | 3.7 | 0.0093 | 0.0533 |
| | 39 GHz | 3.68 | 0.0106 | 0.0848 |
| | Average | 3.5175 | 0.01135 | |

The above antenna module 200 may further include one or more array antennas. This will be described below.

Figure 5A:
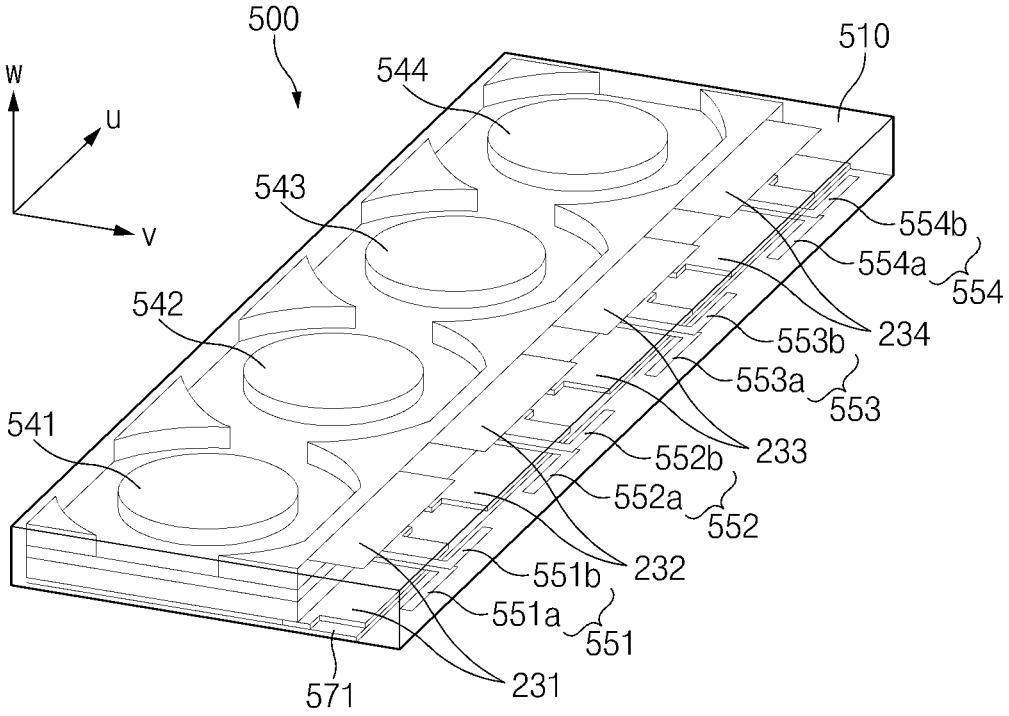
FIGS. 5A to 5C illustrate another example of an antenna module according to an embodiment.
Figure 5B:
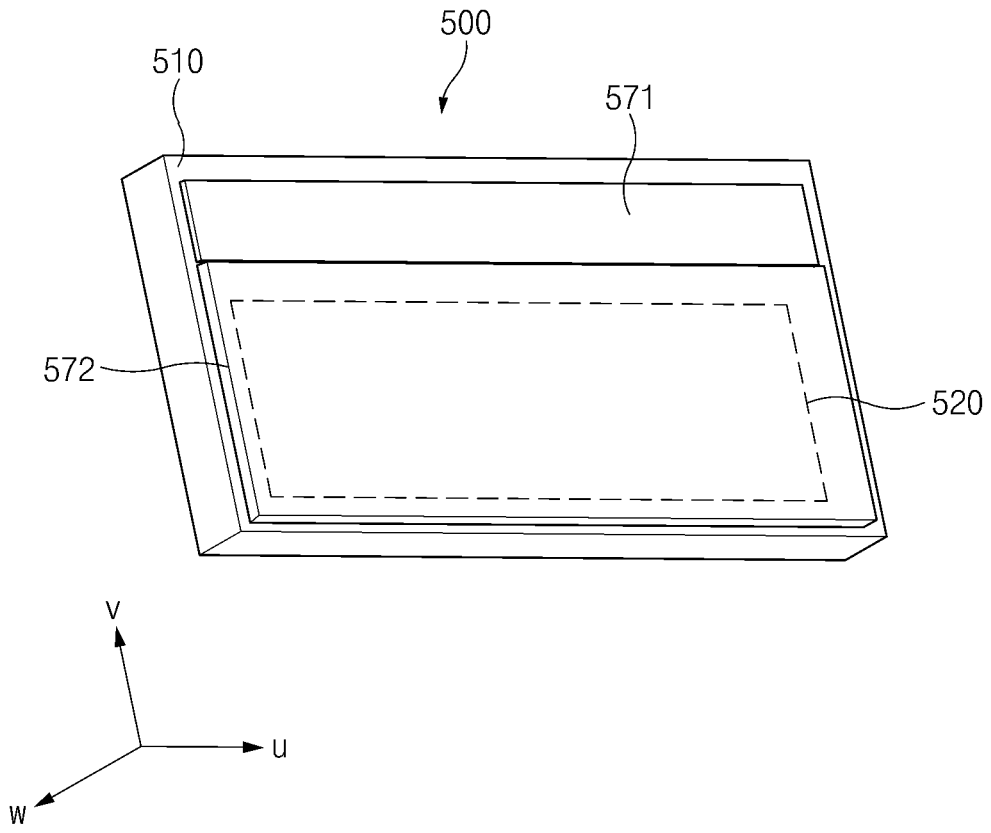
Figure 5C:
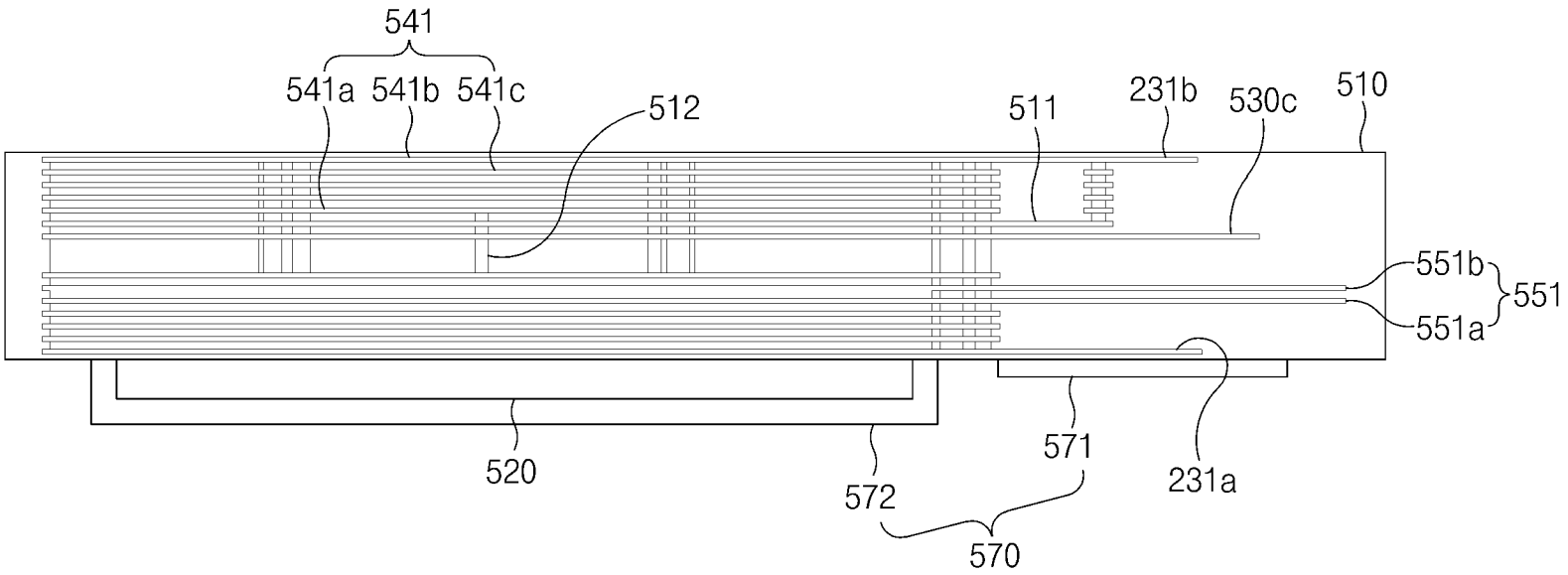
Figure 6A:
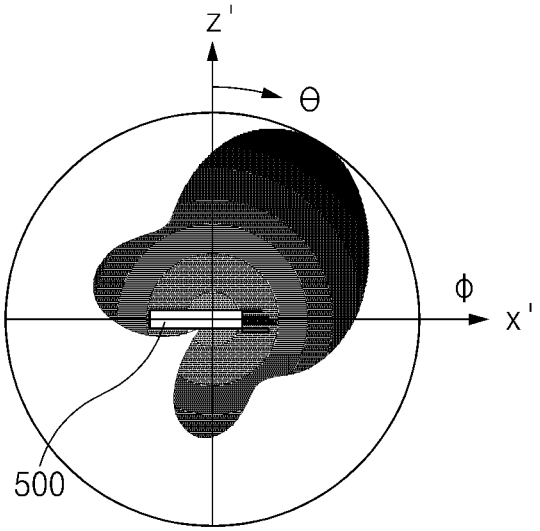
FIGS. 6A to 6D illustrate beam patterns of a first array antenna according to an embodiment.
Figure 6B:
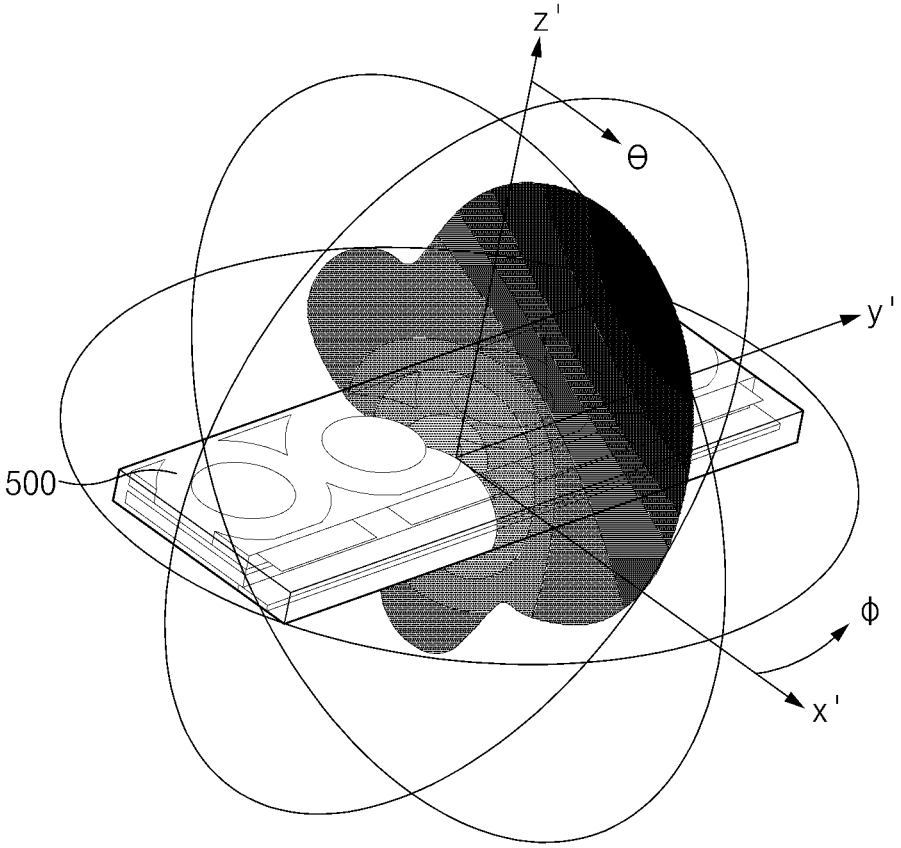
Figure 6C:
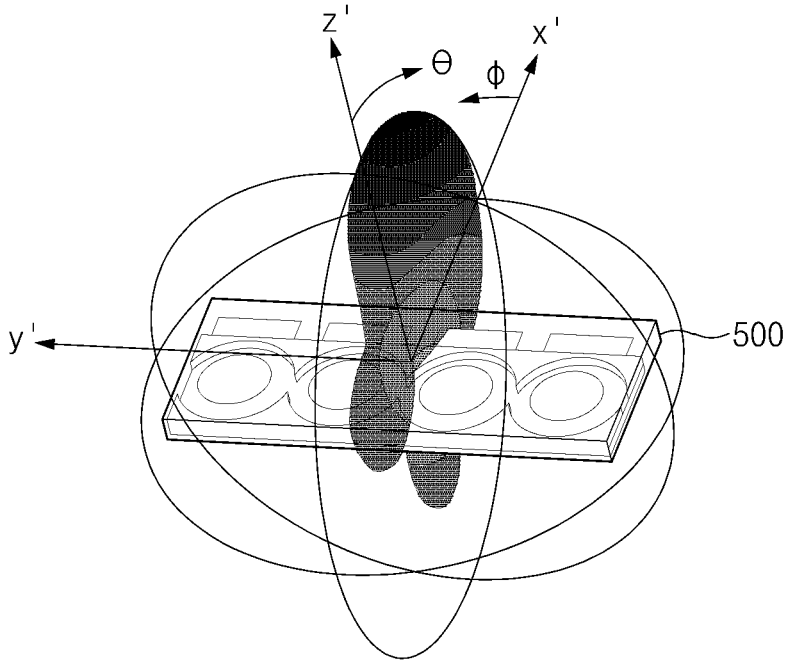
Figure 6D:
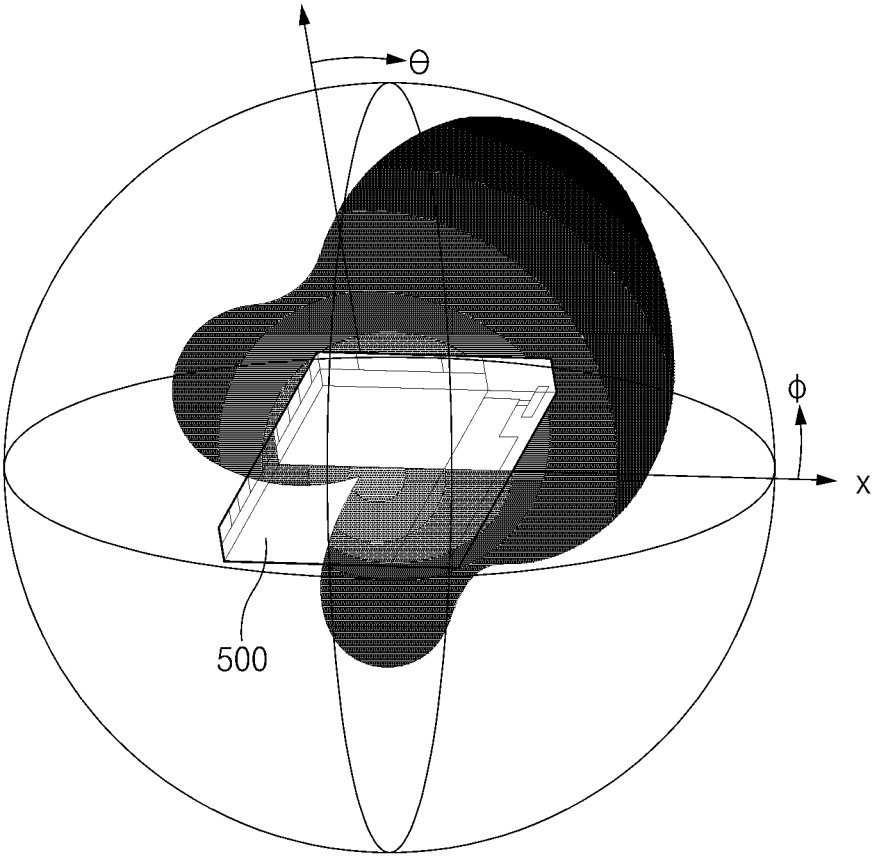

FIGS. 5A to 5C illustrate another example of an antenna module according to an embodiment. FIG. 5A illustrates a perspective view of a first surface of an antenna module according to another embodiment, FIG. 5B illustrates a perspective view of a second surface of an antenna module according to another embodiment, and FIG. 5C illustrates a cross-sectional view of an antenna module according to another embodiment.

Referring to FIGS. 5A to 5C, an antenna module 500 according to an embodiment may include a printed circuit board 510 (e.g., the printed circuit board 210), a communication circuit 520 (e.g., the communication circuit 220 of FIG. 2A or 2B), a first array antenna 530 (e.g., the array antenna 230 of FIG. 2A or 2B) (including antennas 231, 232, 233, 234), a second array antenna 540 (including antennas 541, 542, 543, 544), a third array antenna 550 (including antennas 551, 552, 553, and 554), and a molding layer 570/571 (e.g., the molding layers 270 of FIG. 2A or 2B). In an embodiment, the antenna module 500 may not include some of the above components or may further include any other components. For example, the antenna module 500 may further include a connector (not illustrated) (e.g., the connector 280 of FIG. 2A or 2B). In an embodiment, some of the components of the antenna module 500 may be combined to form one entity, which may identically perform functions of the some components before the combination. In FIGS. 5A to 5C, with regard to the description given with reference to FIGS. 2A to 4, additional description will be omitted to avoid redundancy.

According to an embodiment, the printed circuit board 510 may be provided to include a plurality of layers. The printed circuit board 510 may be designed with a low-loss printed circuit board appropriate to transmit/receive a high-frequency signal.

According to an embodiment, the first array antenna 530 may include the first to fourth antennas 231, 232, 233, and 234 formed on a first surface (or a first layer) and a second surface (or a second layer) of the printed circuit board 510, so as to be adjacent to a first side surface of the printed circuit board 510. Each antenna (e.g., 231) may include a first antenna element (e.g., 231*a*) and a second antenna element (e.g., 231*b*). The first conductive element (e.g., 231*a*) may be electrically connected with a ground of the communication circuit 520, and the second conductive element (e.g., 231*b*) may be electrically connected with a first feeding node 511 of the communication circuit 520. The first array antenna 530 may radiate a beam by using a first specified direction between a first axis "v" passing through the center of the printed circuit board 210 and a second axis "w" passing through the center of the printed circuit board 210, as a main direction. The first specified direction may be, for example, a direction that forms a specified angle (e.g., 45 degrees) with the second axis "w". The first array antenna 530 corresponds to the array antenna 230 described with reference to FIGS. 2A to 4, and thus, additional description associated with the first array antenna 530 will be omitted to avoid redundancy in FIGS. 5A to 5C.

According to an embodiment, the second array antenna 540 may include fifth to eighth antennas 541, 542, 543, and 544 formed at a plurality of layers of the printed circuit board 510. The second array antenna 540 may radiate a beam facing a second specified direction. The second specified direction may be, for example, a direction parallel to the second axis "w". The second array antenna 540 may be formed parallel to the first array antenna 530 with respect to a direction of a third axis "u". Each antenna (e.g., 541) may include a plurality of conductive elements 541*a*, 541*b*, and 541*c* (e.g., a patch antenna) formed at the plurality of layers. The conductive element 541*a* formed at an inner layer (e.g., a third layer) from among the plurality of conductive elements 541*a*, 541*b*, and 541*c* may be connected with second feeding nodes 512 of the communication circuit 520. The conductive elements 541*b* and 541*c* formed at the remaining layer (e.g., a second layer) from among the plurality of conductive elements 541*a*, 541*b*, and 541*c* may be connected with the ground or may be floated. The floated conductive elements may support a beam pattern of the second array antenna 540 so as to face the second specified direction.

According to an embodiment, the third array antenna 550 may include ninth to twelfth antennas 551, 552, 553, and 554 formed at a plurality of layers of the printed circuit board 510. The third array antenna 550 may radiate a beam facing a third specified direction. The third specified direction may be, for example, a direction facing a direction of the first axis "v". The third array antenna 550 may be formed to overlap the first array antenna 530 with respect to the direction of the second axis "w". Each antenna (e.g., 551) may include a third antenna element (e.g., 551*a*) and a fourth antenna element (e.g., 551*b*) formed at a plurality of inner layers (e.g., a fourth layer and a fifth layer) of the printed circuit board 510. The third conductive element (e.g., 551*a*) may be electrically connected with the ground of the communication circuit 520, and the fourth conductive element (e.g., 551*b*) may be electrically connected with third feeding nodes of the communication circuit 520. The third conductive element (e.g., 551*a*) and the fourth conductive element (e.g., 551*b*) may include first portions disposed in parallel with each other and second portions facing opposite directions and forming a right angle with the first portions. The third conductive element (e.g., 551*a*) and the fourth conductive element (e.g., 551*b*) may be, for example, a dipole antenna.

According to an embodiment, the molding layer 570 may include a first molding layer 571 provided to cover the first conductive element (e.g., 231*a*) of the first array antenna 530 formed on the first surface of the printed circuit board 510. The molding layer 570 may further include a second molding layer 572 (e.g., the second molding layer 272 of FIG. 2A or 2B) provided to cover the communication circuit 520. The molding layer 570 is described with reference to FIGS. 2A to 4, and thus, additional description will be omitted to avoid redundancy.

According to an embodiment, a connector (not illustrated) may be mounted on the first surface of the printed circuit board 510 and may electrically connect the printed circuit board 510 and any other printed circuit board (e.g., the printed circuit board 140 of FIG. 1) on which a processor (e.g., the processor 141) is mounted. In the case where the printed circuit board 140 and the printed circuit board 510 are electrically connected by the connector (not illustrated), the communication circuit 520 may be electrically connected with the processor 141 and may transmit/receive a first high-frequency signal with the first array antenna 530 under control of the processor 141. Also, the communication circuit 520 may transmit/receive a second high-frequency signal with the second array antenna 540 or may transmit/receive a third high-frequency signal with the third array antenna 550.

According to certain embodiments, the antenna module 500 may not include the first array antenna 530. In this case, the first molding layer 571 may improve the performance of the third array antenna 550. This will be described with reference to FIGS. 9A to 9C below.

According to the above embodiment, the antenna module 500 may gather beams of the first array antenna 530 by using the first molding layer 571, and thus, may improve the performance of the first array antenna 530.

Also, according to the above embodiment, in the case of adding the first molding layer 571 for improving the performance of the first array antenna 530 on the first surface of the printed circuit board 510 where the communication circuit 520 is mounted, because the first molding layer 571 is lower in height than the communication circuit 520, the first molding layer 271 may have no influence on a substantial thickness of the antenna module 500.

FIGS. 6A to 6D illustrate beam patterns of a first array antenna (e.g., the first array antenna 530 of FIG. 5A) according to an embodiment.

Referring to FIGS. 6A to 6D, the first array antenna 530 may radiate a beam facing a specified direction between a first axis x' and a second axis z'. The specified direction may be, for example, a direction in which φ (phi) is 45 degrees and θ (theta) is 45 degrees.

FIGS. 7A to 7D illustrate a change of a far field characteristic of the first array antenna 530 before and after the first molding layer 571 according to an embodiment is applied. Left characteristics of FIGS. 7A to 7D may illustrate beam patterns and gains of the first array antenna 530 to which the first molding layer 571 is not applied, and right characteristics thereof may illustrate beam patterns and gains of the first array antenna 530 to which the first molding layer 571 is applied.

Figure 7A:
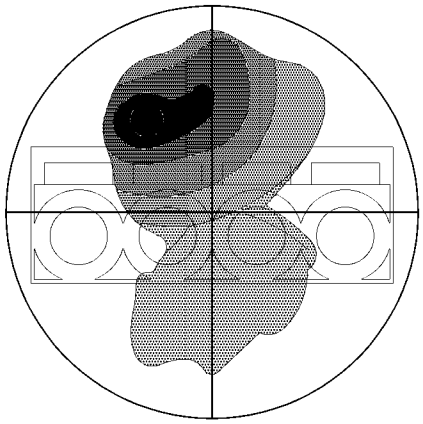
FIGS. 7A to 7D illustrate a change of a far field characteristic of first to fourth array antennas belonging to a first array antenna before and after a first molding layer according to an embodiment is applied.
Figure 7A:
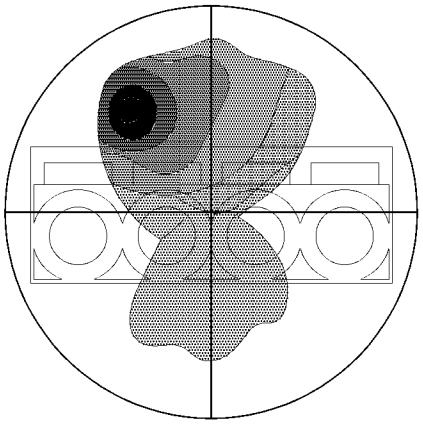

Referring to FIG. 7A, it may be understood that a far field gain of the first antenna 231 belonging to the first array antenna 530 is improved from 1.983 dBi (characteristic: 711) before the application of the first molding layer 571 to 2.071 dBi (characteristic: 712) after the application of the first molding layer 571.

Figure 7B:
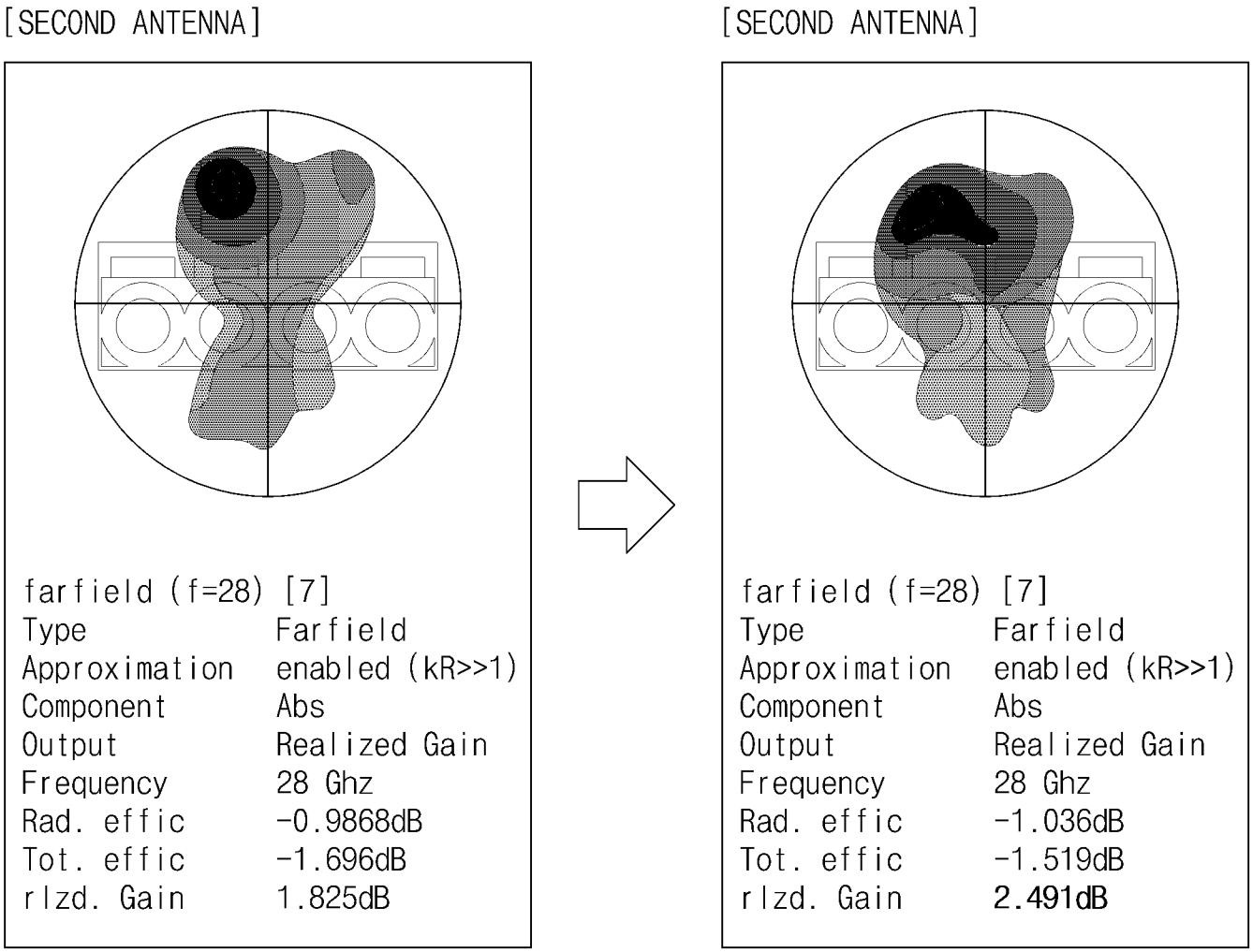

Referring to FIG. 7B, it may be understood that a far field gain of the second antenna 232 belonging to the first array antenna 530 is improved from 1.825 dBi (characteristic: 721) before the application of the first molding layer 571 to 2.491 dBi (characteristic: 722) after the application of the first molding layer 571.

Figure 7C:
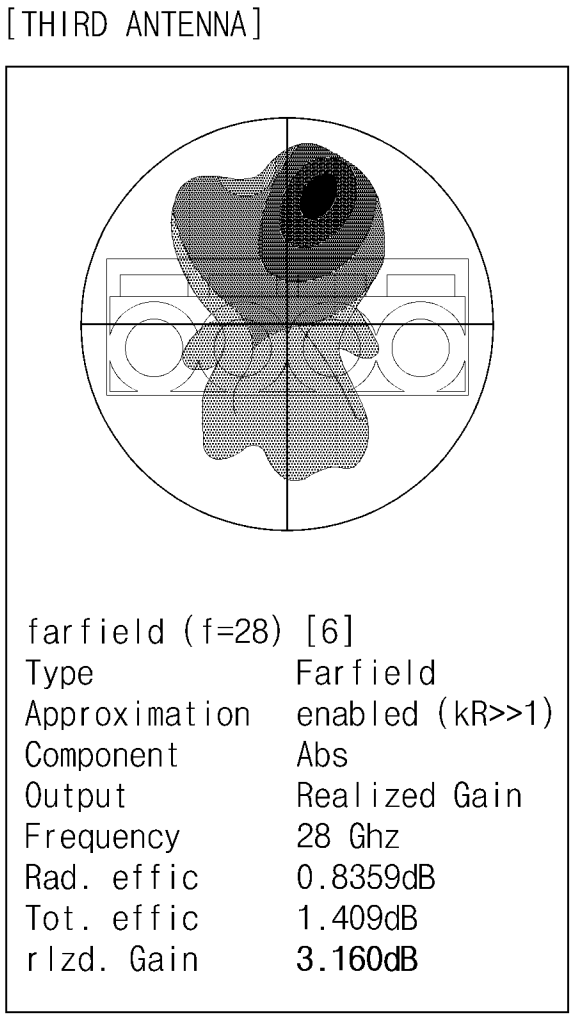
Figure 7C:
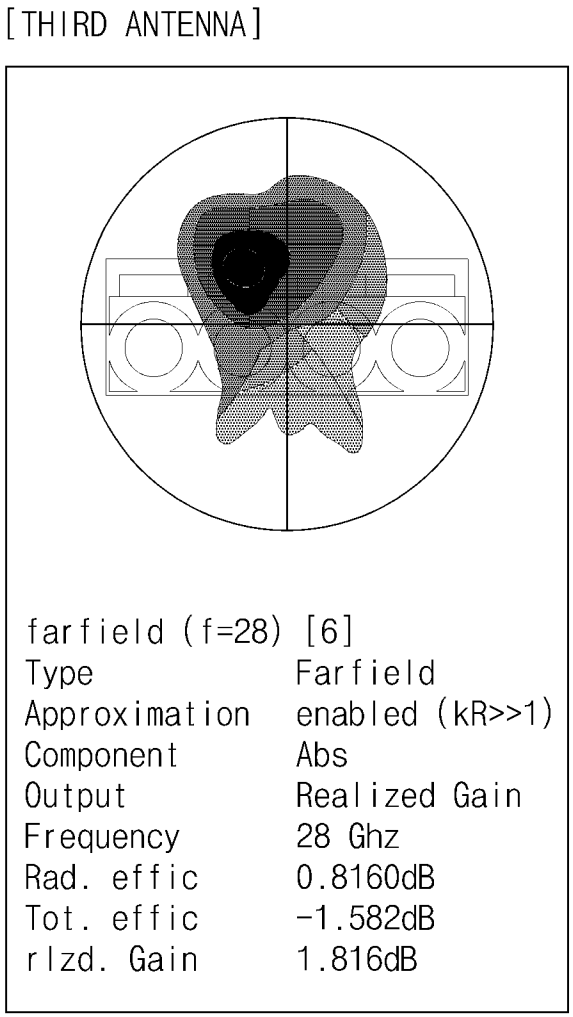

Referring to FIG. 7C, it may be understood that a far field gain of the third antenna 233 belonging to the first array antenna 530 is improved from 1.816 dBi (characteristic: 731) before the application of the first molding layer 571 to 3.160 dBi (characteristic: 732) after the application of the first molding layer 571.

Figure 7D:
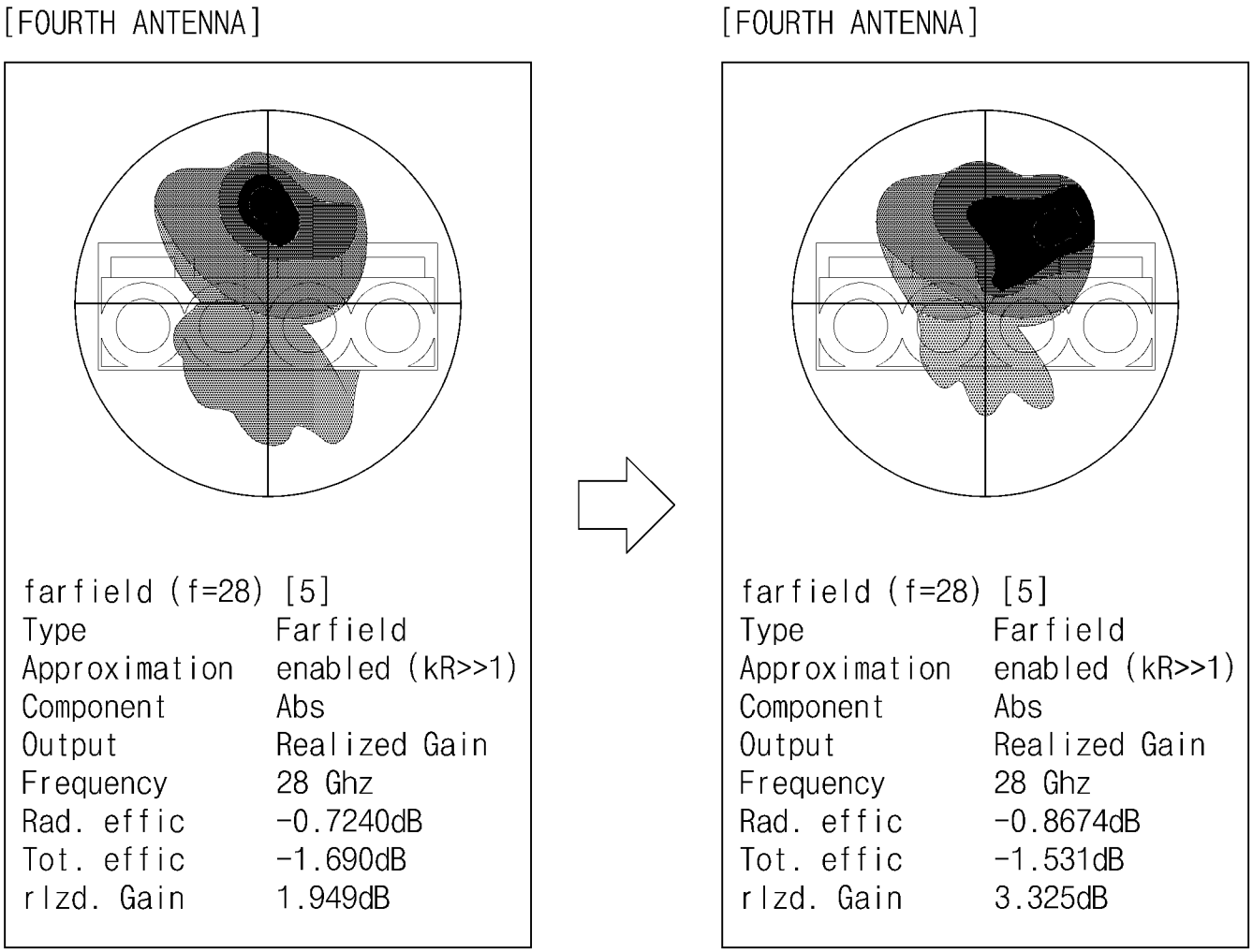

Referring to FIG. 7D, it may be understood that a far field gain of the fourth antenna 234 belonging to the first array antenna 530 is improved from 1.949 dBi (characteristic: 741) before the application of the first molding layer 571 to 3.325 dBi (characteristic: 742) after the application of the first molding layer 571.

Figure 8:
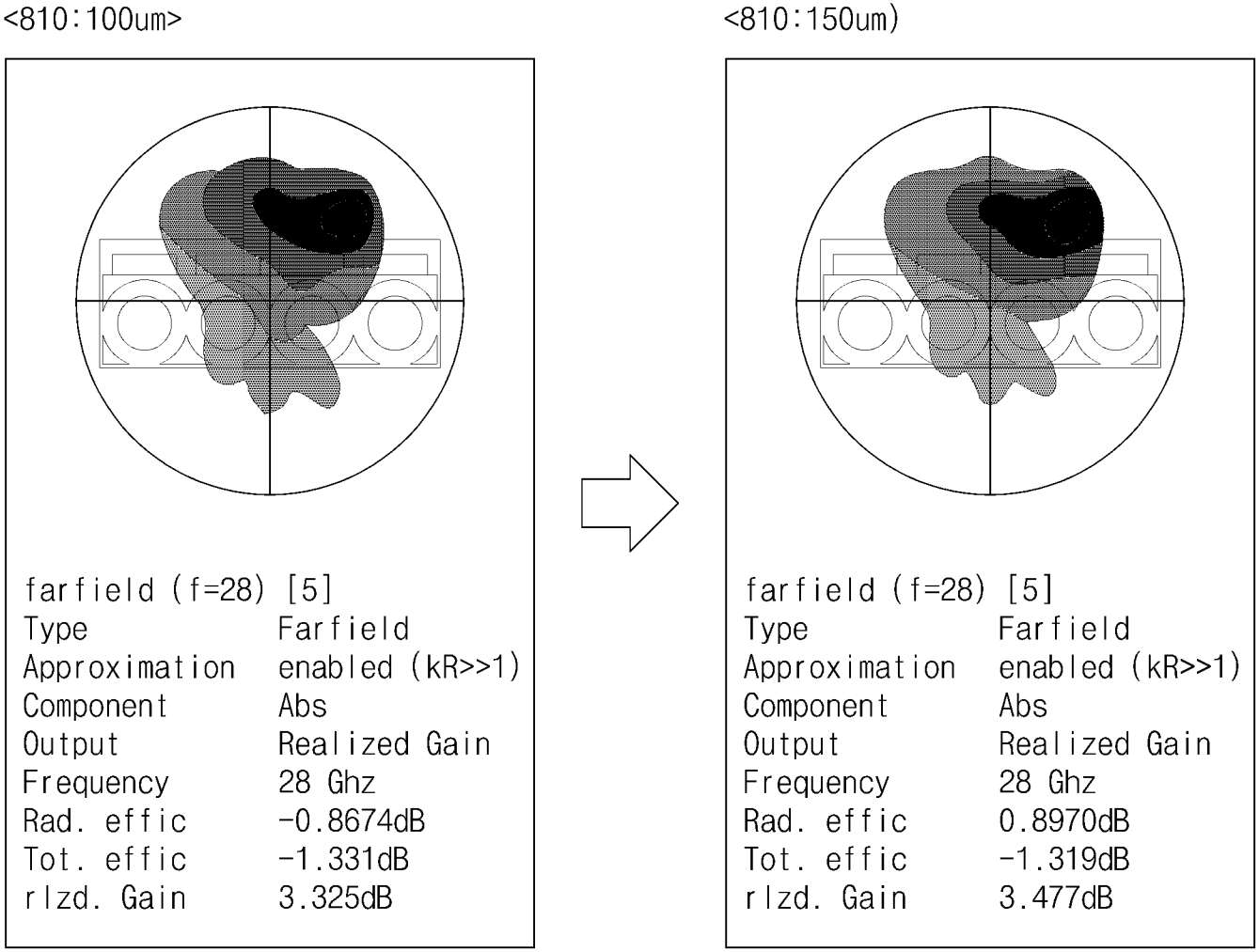
FIG. 8 illustrates how a far field characteristic of a first array antenna varies with a thickness of a first molding layer according to an embodiment.

FIG. 8 illustrates how a far field characteristic of a first array antenna (e.g., the first array antenna 530 of FIG. 5A, 5B, or 5C) varies with a thickness of a first molding layer (e.g., the first molding layer 571 of FIG. 5A, 5B, or 5C) according to an embodiment. In FIG. 8, characteristic 810 illustrates a beam pattern and a gain of one antenna (e.g., 231) belonging to the first array antenna 530 when a thickness of the first molding layer 571 is approximately 100 μm, and characteristic 820 illustrates a beam pattern and a gain of one antenna (e.g., 231) belonging to the first array antenna 530 when a thickness of the first molding layer 571 is approximately 150 μm.

Referring to FIG. 8, it may be understood that the gain of the antenna (e.g., 231) belonging to the first array antenna 530 is improved in all the cases where a thickness of the first molding layer 571 is approximately 100 μm and is approximately 150 μm and that a gain error due to a thickness change is not great.

According to the above embodiment, the first molding layer 571 may improve the performances of the first to fourth antennas 231, 232, 233, and 234 evenly.

Figure 9A:
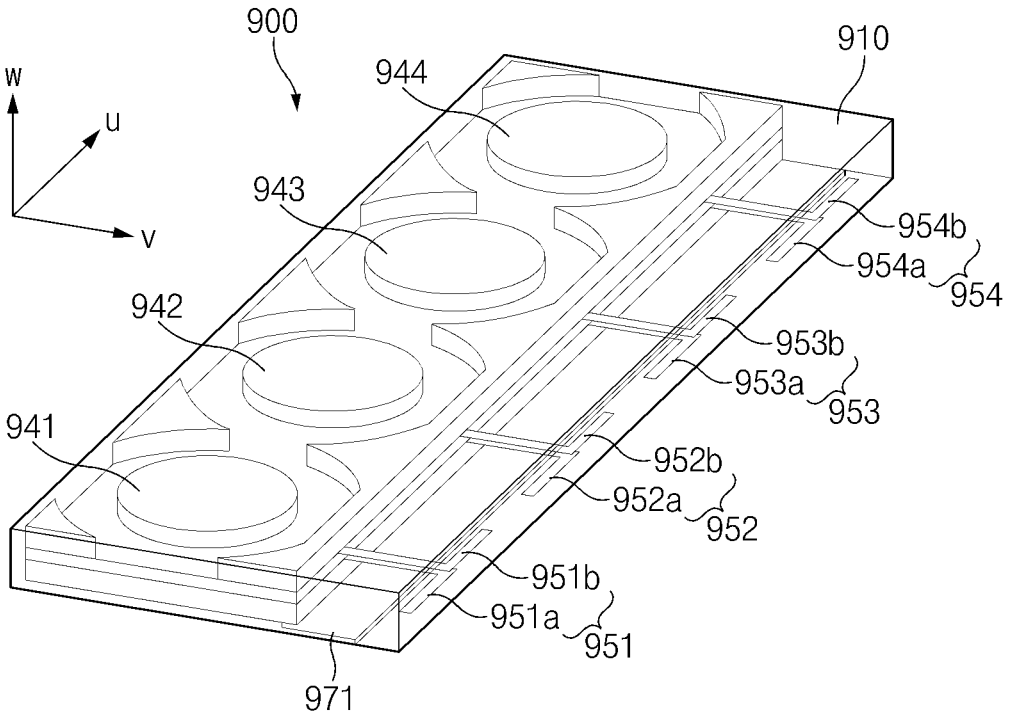
FIGS. 9A to 9C illustrate another example of an antenna module according to an embodiment.
Figure 9B:
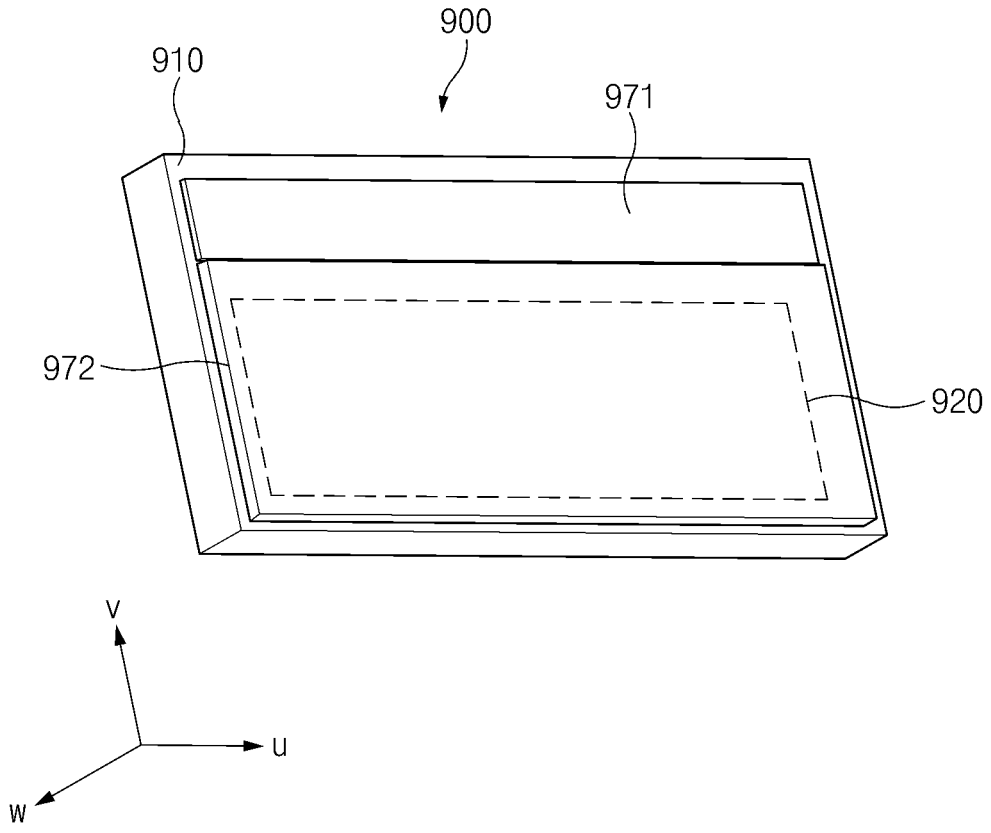
Figure 9C:
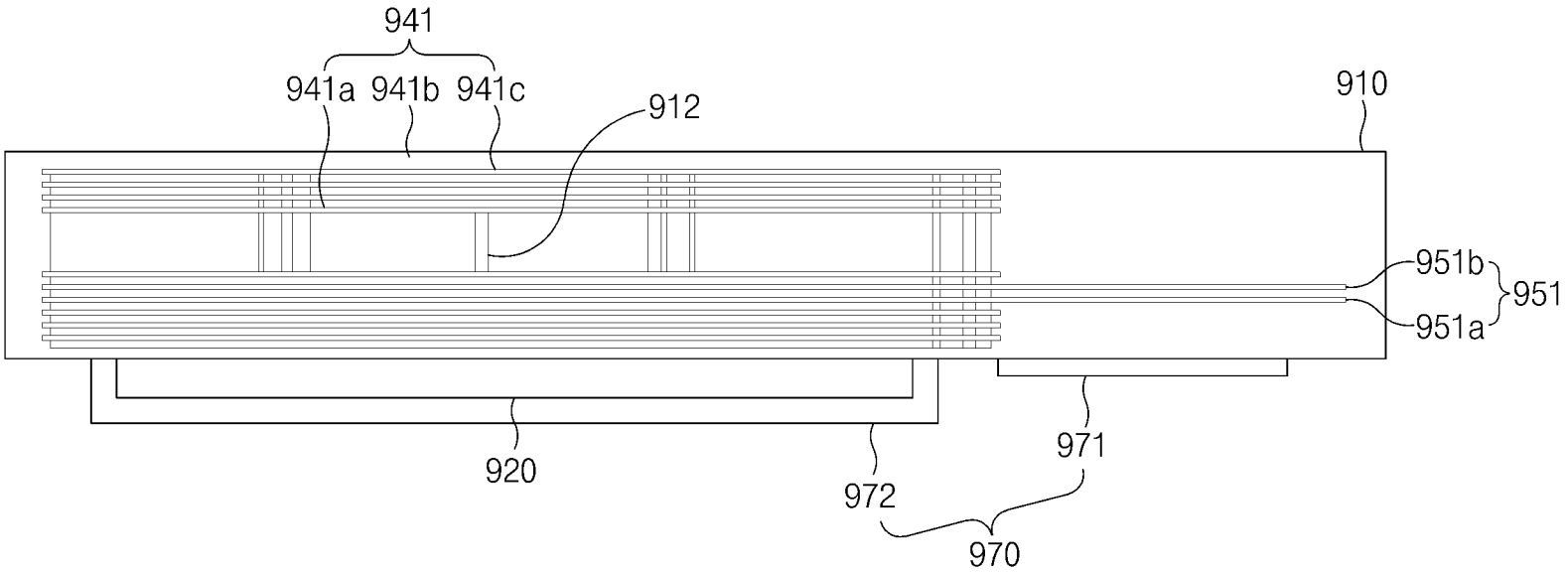

FIGS. 9A to 9C illustrate another example of an antenna module according to an embodiment. FIG. 9A illustrates a perspective view of a first surface of an antenna module according to another embodiment, FIG. 9B illustrates a perspective view of a second surface of an antenna module according to another embodiment, and FIG. 9C illustrates a cross-sectional view of an antenna module according to another embodiment.

Referring to FIGS. 9A to 9C, an antenna module 900 according to an embodiment may include a printed circuit board 910 (e.g., the printed circuit board 210), a communication circuit 920 (e.g., the communication circuit 220 of FIG. 2A or 2B), an array antenna 940 (e.g., the second array antenna 540 of FIG. 5A), an array antenna 950, and a molding layer 970 (e.g., the molding layers 270 of FIG. 2A or 2B). In an embodiment, the antenna module 900 may not include some of the above components or may further include any other components. For example, the array antenna 940 of the antenna module 900 may be omitted. In an embodiment, some of the components of the antenna module 900 may be combined to form one entity, which may identically perform functions of the some components before the combination. In FIGS. 9A to 9C, with regard to the description given with reference to FIGS. 5A to 5C, additional description will be omitted to avoid redundancy.

According to an embodiment, the printed circuit board 910 may be provided to have a plurality of layers. The printed circuit board 910 may be designed with a low-loss printed circuit board appropriate to transmit/receive a high-frequency signal.

According to an embodiment, the array antenna 940 may include fifth to eighth antennas 941, 942, 943, and 944 formed at a plurality of layers of the printed circuit board 910. The array antenna 940 may radiate a beam facing a second specified direction. The second specified direction may be, for example, a direction parallel to the second axis "w". Each antenna (e.g., 941) may include a plurality of conductive elements 941*a*, 941*b*, and 941*c* (e.g., a patch antenna) formed at the plurality of layers of the printed circuit board 910. The conductive element 941*a* formed at an inner layer (e.g., a third layer) from among the plurality of conductive elements 941*a*, 941*b*, and 941*c* may be connected with second feeding nodes 912 of the communication circuit 920. The conductive elements 941*b* and 941*c* formed at the remaining layer (e.g., a second layer) from among the plurality of conductive elements 941*a*, 941*b*, and 941*c* may be connected with the ground or may be floated. The floated conductive elements may support a beam pattern of the array antenna 940 so as to face the second specified direction.

According to an embodiment, the array antenna 950 may include ninth to twelfth antennas 951, 952, 953, and 954 formed at a plurality of layers of the printed circuit board 910. The array antenna 950 may radiate a beam facing a third specified direction. The third specified direction may be, for example, a direction facing a direction of the first axis "v". The array antenna 950 may be formed at a different layer from the array antenna 940, but may be formed parallel to the array antenna 950 with respect to the direction of the third axis "u" when viewed from above the first surface of the printed circuit board 910. Each antenna (e.g., 951) may include a third antenna element (e.g., 951*a*) and a fourth antenna element (e.g., 951*b*) formed at a plurality of inner layers (e.g., a fourth layer and a fifth layer) of the printed circuit board 910. The third conductive element (e.g., 951*a*) may be electrically connected with the ground of the communication circuit 920, and the fourth conductive element (e.g., 951*b*) may be electrically connected with third feeding nodes of the communication circuit 920. The third conductive element (e.g., 951*a*) and the fourth conductive element (e.g., 951*b*) may include first portions disposed in parallel with each other and second portions facing opposite directions and forming a right angle with the first portions. The third conductive element (e.g., 951*a*) and the fourth conductive element (e.g., 951*b*) may be, for example, a dipole antenna.

According to an embodiment, the molding layer 970 may include a first molding layer 971 (e.g., the second molding layer 272 of FIG. 2A or 2B) provided to cover at least a part (e.g., all) of third conductive elements 951*a*, 952*a*, 953*a*, and 954*a* and fourth conductive elements 951*b*, 952*b*, 953*b*, and 954*b* of the array antenna 950 when viewed from above the first surface of the printed circuit board 910. The molding layer 970 may further include a second molding layer 972 (e.g., the second molding layer 272 of FIG. 2A or 2B) provided to cover the communication circuit 920. The first molding layer 971 and the second molding layer 972 may be formed by the same molding process. The molding layer 970 is described with reference to FIGS. 2A to 4, and thus, additional description will be omitted to avoid redundancy.

According to an embodiment, under control of the processor 141, the communication circuit 920 may transmit/receive the second high-frequency signal with the array antenna 940 or may transmit/receive the third high-frequency signal with the array antenna 950.

According to the above embodiment, the antenna module 900 may gather beams of the array antenna 950 by using the first molding layer 971, and thus, may improve the performance of the array antenna 950.

Also, according to the above embodiment, in the case of adding the first molding layer 971 for improving the performance of the array antenna 950 on the first surface of the printed circuit board 910 where the communication circuit 920 is mounted, because the first molding layer 971 is lower in height than the communication circuit 920, the first molding layer 971 may have no influence on a substantial thickness of the antenna module 900; in addition, because the first molding layer 971 is provided in the process of forming the second molding layer 972 covering the communication circuit 920, an additional process may not be required.

According to an embodiment, an antenna module (e.g., the antenna module 900 of FIG. 9A) may include a printed circuit board (e.g., the printed circuit board 910 of FIG. 9A), a communication circuit (e.g., the communication circuit 920 of FIG. 9B or 9C) that is disposed on a first surface of the printed circuit board, an array antenna (e.g., the array antenna 950 of FIG. 9A) that transmits/receives a signal in a specified high-frequency band with the communication circuit, wherein the array antenna includes first conductive elements (e.g., the third conductive element 951*a* and the fourth conductive element 951*b* of FIG. 9A) formed at a first layer of the printed circuit board, and a first molding layer (e.g., the first molding layer 971) that is formed above the second surface of the printed circuit board so as to cover at least a part of the first conductive elements, when viewed from above a second surface of the printed circuit board.

Figure 10:
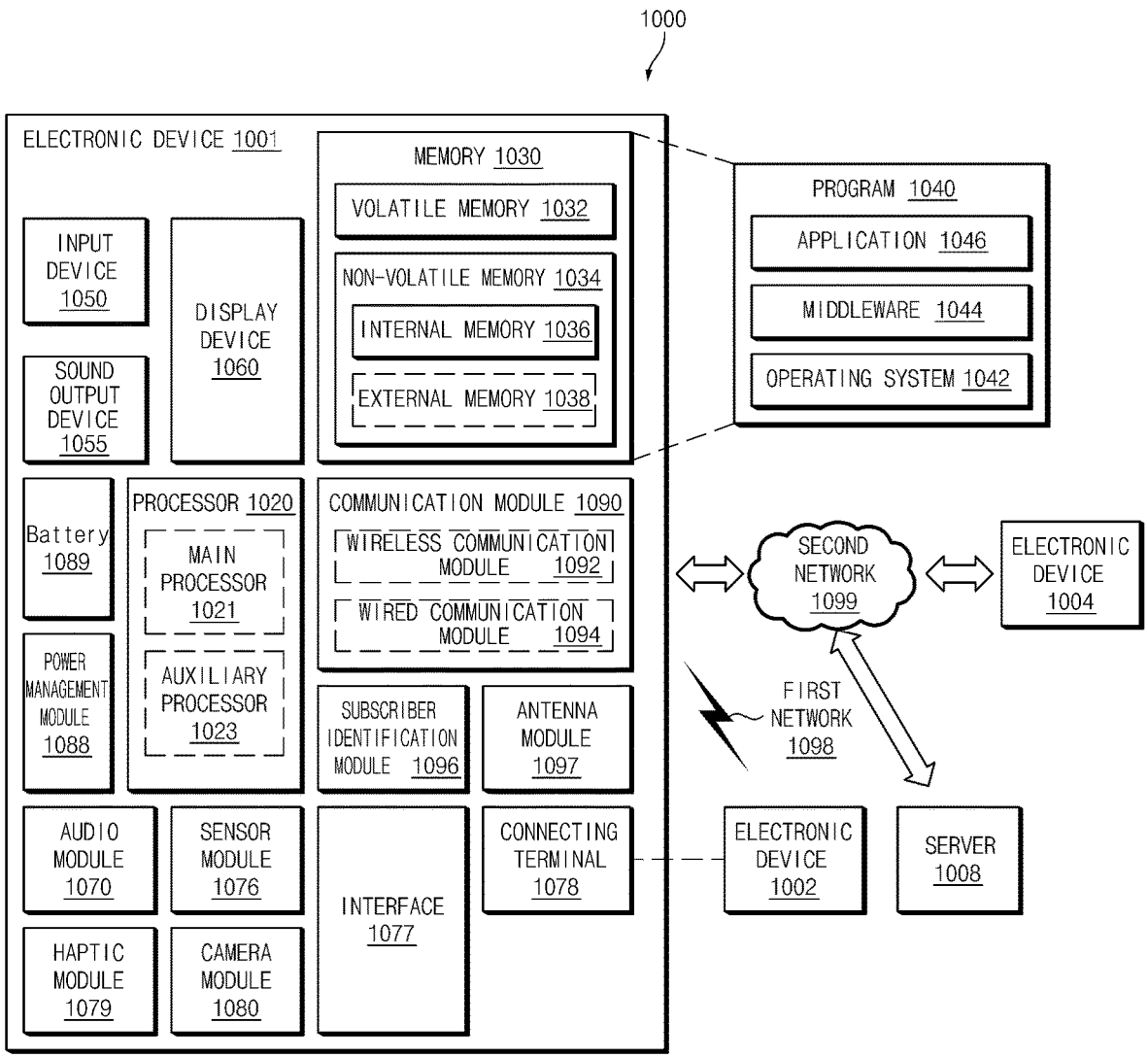
FIG. 10 illustrates a block diagram of an electronic device in a network environment according to certain embodiments.

FIG. 10 is a block diagram illustrating an electronic device 1001 in a network environment 1000 according to certain embodiments. Referring to FIG. 10, the electronic device 1001 in the network environment 1000 may communicate with an electronic device 1002 via a first network 1098 (e.g., a short-range wireless communication network), or an electronic device 1004 or a server 1008 via a second network 1099 (e.g., a long-range wireless communication network). According to an embodiment, the electronic device 1001 may communicate with the electronic device 1004 via the server 1008. According to an embodiment, the electronic device 1001 may include a processor 1020, memory 1030, an input device 1050, a sound output device 1055, a display device 1060, an audio module 1070, a sensor module 1076, an interface 1077, a haptic module 1079, a camera module 1080, a power management module 1088, a battery 1089, a communication module 1090, a subscriber identification module (SIM) 1096, or an antenna module 1097. In some embodiments, at least one (e.g., the display device 1060 or the camera module 1080) of the components may be omitted from the electronic device 1001, or one or more other components may be added in the electronic device 1001. In some embodiments, some of the components may be implemented as single integrated circuitry. For example, the sensor module 1076 (e.g., a fingerprint sensor, an iris sensor, or an illuminance sensor) may be implemented as embedded in the display device 1060 (e.g., a display).

The processor 1020 may execute, for example, software (e.g., a program 1040) to control at least one other component (e.g., a hardware or software component) of the electronic device 1001 coupled with the processor 1020, and may perform various data processing or computation. According to one embodiment, as at least part of the data processing or computation, the processor 1020 may load a command or data received from another component (e.g., the sensor module 1076 or the communication module 1090) in volatile memory 1032, process the command or the data stored in the volatile memory 1032, and store resulting data in non-volatile memory 1034. According to an embodiment, the processor 1020 may include a main processor 1021 (e.g., a central processing unit (CPU) or an application processor (AP)), and an auxiliary processor 1023 (e.g., a graphics processing unit (GPU), an image signal processor (ISP), a sensor hub processor, or a communication processor (CP)) that is operable independently from, or in conjunction with, the main processor 1021. Additionally or alternatively, the auxiliary processor 1023 may be adapted to consume less power than the main processor 1021, or to be specific to a specified function. The auxiliary processor 1023 may be implemented as separate from, or as part of the main processor 1021.

The auxiliary processor 1023 may control at least some of functions or states related to at least one component (e.g., the display device 1060, the sensor module 1076, or the communication module 1090) among the components of the electronic device 1001, instead of the main processor 1021 while the main processor 1021 is in an inactive (e.g., sleep) state, or together with the main processor 1021 while the main processor 1021 is in an active state (e.g., executing an application). According to an embodiment, the auxiliary processor 1023 (e.g., an image signal processor or a communication processor) may be implemented as part of another component (e.g., the camera module 1080 or the communication module 1090) functionally related to the auxiliary processor 1023.

The memory 1030 may store various data used by at least one component (e.g., the processor 1020 or the sensor module 1076) of the electronic device 1001. The various data may include, for example, software (e.g., the program 1040) and input data or output data for a command related thereto. The memory 1030 may include the volatile memory 1032 or the non-volatile memory 1034.

The program 1040 may be stored in the memory 1030 as software, and may include, for example, an operating system (OS) 1042, middleware 1044, or an application 1046.

The input device 1050 may receive a command or data to be used by other component (e.g., the processor 1020) of the electronic device 1001, from the outside (e.g., a user) of the electronic device 1001. The input device 1050 may include, for example, a microphone, a mouse, a keyboard, or a digital pen (e.g., a stylus pen).

The sound output device 1055 may output sound signals to the outside of the electronic device 1001. The sound output device 1055 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 1060 may visually provide information to the outside (e.g., a user) of the electronic device 1001. The display device 1060 may include, for example, a display, a hologram device, or a projector and control circuitry to control a corresponding one of the display, hologram device, and projector. According to an embodiment, the display device 1060 may include touch circuitry adapted to detect a touch, or sensor circuitry (e.g., a pressure sensor) adapted to measure the intensity of force incurred by the touch.

The audio module 1070 may convert a sound into an electrical signal and vice versa. According to an embodiment, the audio module 1070 may obtain the sound via the input device 1050, or output the sound via the sound output device 1055 or a headphone of an external electronic device (e.g., an electronic device 1002) directly (e.g., wiredly) or wirelessly coupled with the electronic device 1001.

The sensor module 1076 may detect an operational state (e.g., power or temperature) of the electronic device 1001 or an environmental state (e.g., a state of a user) external to the electronic device 1001, and then generate an electrical signal or data value corresponding to the detected state. According to an embodiment, the sensor module 1076 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 1077 may support one or more specified protocols to be used for the electronic device 1001 to be coupled with the external electronic device (e.g., the electronic device 1002) directly (e.g., wiredly) or wirelessly. According to an embodiment, the interface 1077 may include, for example, a high definition multimedia interface (HDMI), a universal serial bus (USB) interface, a secure digital (SD) card interface, or an audio interface.

A connecting terminal 1078 may include a connector via which the electronic device 1001 may be physically connected with the external electronic device (e.g., the electronic device 1002). According to an embodiment, the connecting terminal 1078 may include, for example, a HDMI connector, a USB connector, a SD card connector, or an audio connector (e.g., a headphone connector).

The haptic module 1079 may convert an electrical signal into a mechanical stimulus (e.g., a vibration or a movement) or electrical stimulus which may be recognized by a user via his tactile sensation or kinesthetic sensation. According to an embodiment, the haptic module 1079 may include, for example, a motor, a piezoelectric element, or an electric stimulator.

The camera module 1080 may capture a still image or moving images. According to an embodiment, the camera module 1080 may include one or more lenses, image sensors, image signal processors, or flashes.

The power management module 1088 may manage power supplied to the electronic device 1001. According to one embodiment, the power management module 1088 may be implemented as at least part of, for example, a power management integrated circuit (PMIC).

The battery 1089 may supply power to at least one component of the electronic device 1001. According to an embodiment, the battery 1089 may include, for example, a primary cell which is not rechargeable, a secondary cell which is rechargeable, or a fuel cell.

The communication module 1090 may support establishing a direct (e.g., wired) communication channel or a wireless communication channel between the electronic device 1001 and the external electronic device (e.g., the electronic device 1002, the electronic device 1004, or the server 1008) and performing communication via the established communication channel. The communication module 1090 may include one or more communication processors that are operable independently from the processor 1020 (e.g., the application processor (AP)) and supports a direct (e.g., wired) communication or a wireless communication. According to an embodiment, the communication module 1090 may include a wireless communication module 1092 (e.g., a cellular communication module, a short-range wireless communication module, or a global navigation satellite system (GNSS) communication module) or a wired communication module 1094 (e.g., a local area network (LAN) communication module or a power line communication (PLC) module). A corresponding one of these communication modules may communicate with the external electronic device via the first network 1098 (e.g., a short-range communication network, such as Bluetooth™, wireless-fidelity (Wi-Fi) direct, or infrared data association (IrDA)) or the second network 1099 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 1092 may identify and authenticate the electronic device 1001 in a communication network, such as the first network 1098 or the second network 1099, using subscriber information (e.g., international mobile subscriber identity (IMSI)) stored in the subscriber identification module 1096.

The antenna module 1097 may transmit or receive a signal or power to or from the outside (e.g., the external electronic device) of the electronic device 1001. According to an embodiment, the antenna module 1097 may include an antenna including a radiating element composed of a conductive material or a conductive pattern formed in or on a substrate (e.g., PCB). According to an embodiment, the antenna module 1097 may include a plurality of antennas. In such a case, at least one antenna appropriate for a communication scheme used in the communication network, such as the first network 1098 or the second network 1099, may be selected, for example, by the communication module 1090 (e.g., the wireless communication module 1092) from the plurality of antennas. The signal or the power may then be transmitted or received between the communication module 1090 and the external electronic device via the selected at least one antenna. According to an embodiment, another component (e.g., a radio frequency integrated circuit (RFIC)) other than the radiating element may be additionally formed as part of the antenna module 1097.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 1001 and the external electronic device 1004 via the server 1008 coupled with the second network 1099. Each of the electronic devices 1002 and 1004 may be a device of a same type as, or a different type, from the electronic device 1001. According to an embodiment, all or some of operations to be executed at the electronic device 1001 may be executed at one or more of the external electronic devices 1002, 1004, or 1008. For example, if the electronic device 1001 should perform a function or a service automatically, or in response to a request from a user or another device, the electronic device 1001, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 1001. The electronic device 1001 may provide the outcome, with or without further processing of the outcome, as at least part of a reply to the request. To that end, a cloud computing, distributed computing, or client-server computing technology may be used, for example.

According to an embodiment, an antenna module (e.g., the antenna module 100 of FIG. 1) may include an antenna module (e.g., the antenna module 200 of FIG. 2A), and a processor (e.g., the processor 141 of FIG. 1) that is electrically connected with the antenna module and transmits/receives a specified high-frequency signal by using the antenna module. The antenna module may include a printed circuit board (e.g., the printed circuit board 210 of FIG. 2A), a communication circuit (e.g., the communication circuit 220 of FIG. 2A) that is disposed on a first surface of the printed circuit board, an array antenna (e.g., the array antenna (230*a*, 230*b*) of FIG. 2A) that transmits/receives a signal in a specified high-frequency band with the communication circuit depending on a command of the processor, wherein the array antenna includes first conductive elements (e.g., the first conductive elements 230*a* of FIG. 2A) formed on the first surface of the printed circuit board and second conductive elements (e.g., the second conductive elements 230*b* of FIG. 2A) formed on a second surface of the printed circuit board so as to face the first conductive elements, and a first molding layer that covers the first conductive elements.

The first molding layer may have a specified thickness.

The first molding layer may be provided such that antennas belonging to the array antenna have a specified characteristic.

The first molding layer may be provided in a specified shape covering all the first conductive elements.

The specified shape may be a shape of one rectangle or a shape in which two or more rectangles are connected.

The first molding layer may be provided to correspond to a shape of the first conductive elements.

The first molding layer may be provided to cover the first conductive elements, with at least one conductive element of the first conductive elements spaced from remaining conductive elements of the first conductive elements as much as a specified gap.

When viewed from above the second surface of the printed circuit board, the first conductive elements may be provided to respectively face the second conductive elements so as to be paired.

The array antenna may be provided to radiate a beam by using a direction, which forms a specified angle with an axis passing through a center of the first printed circuit board and facing the second surface from the first surface of the first printed circuit board, as a main direction.

The electronic device according to certain embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that certain embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Certain embodiments as set forth herein may be implemented as software (e.g., the program 1040) including one or more instructions that are stored in a storage medium (e.g., internal memory 1036 or external memory 1038) that is readable by a machine (e.g., the electronic device 1001). For example, a processor (e.g., the processor 1020) of the machine (e.g., the electronic device 1001) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to certain embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to certain embodiments, each component (e.g., a module or a program) of the above-described components may include a single entity or multiple entities. According to certain embodiments, one or more of the above-described components may be omitted, or one or more other components may be added. Alternatively or additionally, a plurality of components (e.g., modules or programs) may be integrated into a single component. In such a case, according to certain embodiments, the integrated component may still perform one or more functions of each of the plurality of components in the same or similar manner as they are performed by a corresponding one of the plurality of components before the integration. According to certain embodiments, operations performed by the module, the program, or another component may be carried out sequentially, in parallel, repeatedly, or heuristically, or one or more of the operations may be executed in a different order or omitted, or one or more other operations may be added.

According to embodiments of the disclosure, the performance of an antenna module may be improved by applying a molding layer to a portion of an array antenna. Besides, a variety of effects directly or indirectly understood through this disclosure may be provided.

While the disclosure has been shown and described with reference to certain embodiments thereof, it will be understood by those skilled in the art that various changes in form and details may be made therein without departing from the spirit and scope of the disclosure as defined by the appended claims and their equivalents.

What is claimed is:

1. An antenna module comprising:

a printed circuit board;

a communication circuit disposed on a first surface of the printed circuit board;

an array antenna configured to transmit/receive a signal in a specified high-frequency band with the communication circuit, wherein the array antenna includes:

first conductive elements disposed on the first surface of the printed circuit board, and second conductive elements disposed on a second surface facing the first conductive elements; and the antenna module further comprising:

a first molding layer covering the first conductive elements, with at least one conductive element of the first conductive elements spaced from remaining conductive elements of the first conductive elements by an interval, and being lower in height than the communication circuit, and a second molding layer covering the communication circuit, a metallic compound disposed on the second molding layer, wherein the first molding layer and the second molding layer comprise epoxy resin, wherein the first molding layer has a thickness between 100 μm to 170 μm and has a shape, corresponding to a shape of the first conductive elements, of one rectangle or a shape in which two or more rectangles are connected, wherein the first molding layer is provided such that antennas belonging to the array antenna have a specified characteristic, wherein, when viewed from above the second surface of the printed circuit board, the first conductive elements are provided to respectively face the second conductive elements, wherein the array antenna is configured to radiate a beam with a direction, which forms a specified angle with an axis passing through a center of the printed circuit board and facing the second surface from the first surface of the printed circuit board, as a main direction, and wherein the beam comprises a main lobe, and wherein the main lobe is approximately 45 degrees with the axis.

2. The antenna module of claim 1, wherein, in the specified characteristic, a gain difference between antennas where the first conductive elements and the second conductive elements are paired is within 0.5 dBi, and a total gain of the array antenna is 8 dBi or greater.

3. An electronic device comprising:

an antenna module; and a processor electrically connected with the antenna module, and configured to transmit/receive a specified high-frequency signal by using the antenna module, wherein the antenna module includes:

a printed circuit board;

a communication circuit disposed on a first surface of the printed circuit board;

an array antenna configured to transmit and receive a signal in a frequency band exceeding 3 GHz with the communication circuit based on a command of the processor, wherein the array antenna includes first conductive elements formed on the first surface of the printed circuit board and second conductive elements formed on a second surface of the printed circuit board facing the first conductive elements;

a first molding layer covering the first conductive elements, with at least one conductive element of the first conductive elements spaced from remaining conductive elements of the first conductive elements by an interval, and being lower in height than the communication circuit, and a second molding layer covering the communication circuit, a metallic compound disposed on the second molding layer, wherein the first molding layer and the second molding layer comprise epoxy resin, wherein the first molding layer has a thickness between 100 μm to 170 μm and has a shape, corresponding to a shape of the first conductive elements, of one rectangle or a shape in which two or more rectangles are connected, wherein the first molding layer is provided such that antennas belonging to the array antenna have a specified characteristic, wherein, when viewed from above the second surface of the printed circuit board, the first conductive elements are provided to respectively face the second conductive elements, wherein the array antenna is configured to radiate a beam with a direction, which forms a specified angle with an axis passing through a center of the printed circuit board and facing the second surface from the first surface of the printed circuit board, as a main direction, and wherein the beam comprises a main lobe, and wherein the main lobe is approximately 45 degrees with the axis.

4. The electronic device of claim 3, wherein, in the specified characteristic, a gain difference between antennas where the first conductive elements and the second conductive elements are paired is within 0.5 dBi, and a total gain of the array antenna is 8 dBi or greater.

* * * * *